US008991584B2

(12) United States Patent
Nishida

(10) Patent No.: US 8,991,584 B2
(45) Date of Patent: Mar. 31, 2015

(54) COIN DEPOSITING AND DISPENSING MACHINE

(75) Inventor: Eisei Nishida, Himeji (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 973 days.

(21) Appl. No.: 12/441,018

(22) PCT Filed: Dec. 6, 2007

(86) PCT No.: PCT/JP2007/073578
§ 371 (c)(1),
(2), (4) Date: Mar. 12, 2009

(87) PCT Pub. No.: WO2008/072544
PCT Pub. Date: Jun. 19, 2008

(65) Prior Publication Data

US 2010/0015903 A1 Jan. 21, 2010

(30) Foreign Application Priority Data

Dec. 8, 2006 (JP) ..... 2006-331302

(51) Int. Cl.
*G07F 1/04* (2006.01)
*G07D 9/00* (2006.01)

(52) U.S. Cl.
CPC . *G07D 9/008* (2013.01); *G07D 9/00* (2013.01)
USPC ..... 194/344; 194/346; 194/350; 453/7; 453/11; 453/56

(58) Field of Classification Search
CPC ..... G07D 3/14; G07D 3/16; G07D 3/02; G07D 9/00; G07D 9/06; G07D 9/065; G07D 1/02; G07D 1/00; G07D 9/008; G07F 5/24
USPC ..... 453/7, 11, 56; 194/344, 346, 350; 198/468.1, 468.11, 468.6, 469.1, 198/479.1, 487.1, 699.1, 728, 747, 748, 198/795, 867.13, 867.14
See application file for complete search history.

(56) References Cited

U.S. PATENT DOCUMENTS

| | | | | |
|---|---|---|---|---|
| 6,039,643 | A | 3/2000 | Kurosawa et al. | |
| 6,637,576 | B1 * | 10/2003 | Jones et al. | 194/216 |
| 2003/0201146 | A1 * | 10/2003 | Abe et al. | 194/302 |

FOREIGN PATENT DOCUMENTS

| | | | |
|---|---|---|---|
| EP | 1 020 819 | A1 | 7/2000 |
| GB | 2 386 734 | A | 9/2003 |

(Continued)

OTHER PUBLICATIONS

Derwent translation of JP 2004326542A.*

(Continued)

*Primary Examiner* — Jeffrey Shapiro
(74) *Attorney, Agent, or Firm* — Renner, Kenner, Greive, Bobak, Taylor & Weber

(57) ABSTRACT

A coin depositing and dispensing machine is provided where its transport mechanism is simplified and downsized while coins to be dispensed are subjected to the identifying action. A coin passage 32 is provided in an annular form along which a single annular transporting belt 43 remains supported for transporting the coins. An input feeding portion 34, denomination-specific accommodating and ejecting portions 35, a bulk escrow portion 36 are disposed at the inner side of the coin passage 32. The coin passage 32 has a receiving and transporting zone 39 for receiving the coins released from the input feeding portion 34, the denomination-specific accommodating and ejecting portions 35, and the bulk escrow portion 36 and a sorting and transporting zone 41 for sorting and delivering the coins to the input feeding portion 34, the denomination-specific accommodating and ejecting portions 35, and the bulk escrow portion 36. An identifying and transporting zone 40 where an identifying portion 58 is disposed is also provided between the receiving and transporting zone 39 and the sorting and transporting zone 41. The deposited coins and the dispensing coins can be transported by the single annular transporting belt 43. As the transport mechanism is arranged for common use between a depositing system and a dispensing system, its construction can thus be simplified and downsized.

21 Claims, 9 Drawing Sheets

(56) References Cited

FOREIGN PATENT DOCUMENTS

| | | | |
|---|---|---|---|
| GB | 2 416 061 | A | 1/2006 |
| JP | 3-164993 | A | 7/1991 |
| JP | 08-185561 | A | 7/1996 |
| JP | 2001-101475 | A | 4/2001 |
| JP | 3266436 | B2 | 1/2002 |
| JP | 3549784 | B2 | 4/2004 |
| JP | 2004-199154 | A | 7/2004 |
| JP | 2004-326541 | A | 11/2004 |
| JP | 2004326542 | A * | 11/2004 |
| WO | WO 2007/034699 | A1 | 3/2007 |
| WO | WO-2007/034699 | A1 | 3/2007 |

OTHER PUBLICATIONS

European Supplementary Search Report (dated Mar. 29, 2011-8 pages).

* cited by examiner

COIN DEPOSITING AND DISPENSING MACHINE

CROSS-REFERENCE TO PRIOR APPLICATION

This is the U.S. National Phase Application under 35 U.S.C. §371 of International Patent Application No. PCT/JP2007/073578 filed Dec. 6, 2007, which claims the benefit of Japanese Patent Application No. 2006-331302 filed Dec. 8, 2006, both of them are incorporated by reference herein. The International Application was published in Japanese on Jun. 19, 2008 as WO2008/072544 al under pct article 21(2).

TECHNICAL FIELD

The present invention relates to a coin depositing and dispensing machine for depositing and dispensing coins.

BACKGROUND ART

Coin depositing and dispensing machines have been developed which are electrically connected with casher equipment including electronic cash registers and teller management machines for automatically depositing and dispensing coins upon receiving electric signals from the casher equipment, whereby the transport of cash transactions with customers at the teller's window in a financial institution, for example, can be carried out accurately and rapidly.

A conventional coin depositing and dispensing machine includes a transport mechanism in the depositing system where the coins fed one by one from the coin input port into which the coins have been input for the depositing action are transported, subjected to the identifying action when being transported, sorted into denominations when having been qualified, and accommodated in their respective denomination-specific accommodating and ejecting portions and another transport mechanism in the dispensing system where the coins ejected one by one from the denomination-specific accommodating and ejecting portion are accepted and transported to the coin output port. The transport mechanism in the depositing system is located at an upper part of the machine because the coins are input from the upper side of the machine and the coins sorted at the transport mechanism in the depositing system are dropped downwardly and are accommodated in the denomination-specific accommodating and ejecting portion. In response, the transport mechanism in the dispensing system is located at a lower part of the machine. Accordingly, the two transport mechanisms in the depositing system and the dispensing system are generally arranged one over the other (See Patent Documents 1 and 2 for example).

Patent Document 1: JP 3549784 B1 (pages 6-7, FIG. 1).

Patent Document 2: JP 3266436 B1 (pages 3-5, FIGS. 1 and 2).

DISCLOSURE OF THE INVENTION

Problems to be Solved by the Invention

However, the conventional coin depositing and dispensing machine is disadvantageous that the two transport mechanisms for transporting the coins are provided in both the depositing system and the dispensing system and their arrangement becomes intricate and large in the size. As the result, the coin depositing and dispensing machine will be increased in the overall dimensions and its production cost will increase because the denomination-specific accommodating and ejecting portions are limited only to a smaller coin accommodating capacity.

Also, since the two transport mechanisms in the depositing system and the dispensing system are arranged one over the other, their assembly and maintenance will be troublesome. For example, when the coins are jammed in the transport mechanism of the dispensing system, their jammed condition may hardly be viewed because the other transport mechanism of the depositing system is mounted over the transport mechanism of the dispensing system. Therefore, the jammed coins in the transport mechanism of the dispensing system should be removed by opening the other transport mechanism of the depositing system.

Moreover, the dispensing system includes no identifying portion while the depositing system is equipped with the identifying portion. If the coins of different denominations are mixed and stored in the denomination-specific accommodating and ejecting portion, their denominations may not be checked but dispensed directly thus declining the reliability of the coin accounting task.

The present invention has been developed in view of the above described drawbacks and its object is to provide a coin depositing and dispensing machine where a single transport mechanism is provided for common use between the depositing system and the dispensing system and its arrangement is simplified and downsized, whereby the downsizing of its arrangement can increase the capacity for accommodating the coins to be dispensed while the installation layout can permit the dispensing coins to be subjected to the identifying action, hence improving the reliability of the coin accounting task.

Means for Solving the Problems

As set forth in claim 1, a coin depositing and dispensing machine according to the present invention includes a single annular transporting body, a supporting body for supporting the transporting body rotatably in a circular direction, and a transporting unit for receiving and transporting deposited coins and dispensed coins which are carried on the transporting body.

As set forth in claim 2, in the coin depositing and dispensing machine according to claim 1, the transporting unit drives the transporting body to travel in one direction for transporting the deposited coins and the dispensed coins.

As set forth in claim 3, in the coin depositing and dispensing machine according to claim 1 or 2, the transporting unit has a deposited coin sorting and transporting zone for sorting the deposited coins and a dispensed coin receiving and transporting zone for receiving the dispensing the coins, both of which are located in different regions in the transporting unit.

As set forth in claim 4, in the coin depositing and dispensing machine according to any one of claims 1 to 3, the transporting unit has a plurality of projections provided thereon for pushing and transporting the coins respectively.

As set forth in claim 5, in the coin depositing and dispensing machine according to any one of claims 1 to 4, the transporting unit is connected with a coin input port for receiving the deposited coins, a coin output port for dispensing the dispensing coins, an identifying portion for identifying the coins, an escrow portion for temporarily storing the coins, and an accommodating and ejecting portions for accommodating the coins therein as well as for ejecting the accommodated coins therefrom.

As set forth in claim 6, in the coin depositing and dispensing machine according to any one of claims 1 to 4, at least one or more of functional units include a coin input port for receiving the deposited coins, an input feeding portion for feeding the deposited coins one by one, a coin output portion for discharging the coins to be dispensed, an identifying portion for identifying the coins, a denomination-specific escrow portion for temporarily storing the coins for each denomination, a bulk escrow portion for temporarily storing the coins in bulk, a denomination-specific accommodating and ejecting portion for accommodating the coins in the accommodating and dispensing portion for each denomination as well as for ejecting the stored coins therefrom, a bulk escrow accommodating and ejecting portion for temporarily storing the coins in bulk and ejecting the stored coins, a reject box for accommodating the rejected coins, a recovery cassette for accommodating the recovered coins, a replenish cassette for accommodating the replenished coins, and a diverting gate for diverting the coins from the transporting unit.

As set forth in claim 7, in the coin depositing and dispensing machine according to claim 6, the transporting unit is connected with the functional units.

As set forth in claim 8, in the coin depositing and dispensing machine according to claim 5, the coins input into the coin input portion in a non-aligned state are fed one by one to the transporting unit, transported one by one by the transporting unit, and temporarily stored in the escrow portion when the coins have been identified as normal coins by the identifying portion.

As set forth in claim 9, in the coin depositing and dispensing machine according to claim 5, the coins accommodated at non-aligned state in the accommodating and dispensing portion are fed one by one to the transporting unit, transported one by one by the transporting unit, and dispensed to the coin output portion.

As set forth in claim 10, in the coin depositing and dispensing machine according to claim 5, the coins accommodated at non-aligned state in the accommodating and dispensing portion are fed one by one to the transporting unit, transported one by one along the transporting unit, and discharged to the coin output portion when the coins have been identified as normal coins by the identifying portion.

As set forth in claim 11, in the coin depositing and dispensing machine according to claim 6, the input feeding portion, the bulk escrow portion, and the denomination-specific accommodating and ejecting portion are at least provided and all located at the inner side of the transporting unit of an annular form.

As set forth in claim 12, in the coin depositing and dispensing machine according to claim 6, the input feeding portion, the coin output portion, the identifying portion, the bulk escrow portion, and the denomination-specific accommodating and ejecting portion are at least provided, the input feeding portion and the coin output portion being located at the front side of the machine while the input feeding portion, the denomination-specific accommodating and ejecting portion, the bulk escrow portion, and the identifying portion are located in a succession from the front side to the rear side.

As set forth in claim 13, in the coin depositing and dispensing machine according to claim 12, the coins fed from the input feeding portion, the denomination-specific accommodating and ejecting portion, and the bulk escrow portion are transported in one direction along the transporting passage of the transporting unit and subjected to the identifying action of the identifying portion.

As set forth in claim 14, in the coin depositing and dispensing machine according to claim 6, each of the denomination-specific escrow portion, the bulk escrow portion, the denomination-specific accommodating and ejecting portion, and the bulk escrow accommodating and ejecting portion is arranged for receiving the coins in a non-aligned state and includes a belt mounted between rollers supported pivotably by horizontally extending axes for traveling at an angle upwardly from the upstream side to the downstream side of the movement in the transporting direction, a reverse roller disposed above the downstream side of the movement in the transporting direction for rotating in a reverse direction of the movement of the belt thus to eject the coins, which have been at the non-aligned state, in a single row at a single layer on the belt, and a delivery portion for delivering the coins one by one to the transporting body in the transporting unit.

As set forth in claim 15, in the coin depositing and dispensing machine according to claim 6, the input feeding portion is arranged for receiving the coins in a non-aligned state and includes a belt mounted between rollers supported pivotably by horizontally extending axes for traveling at an angle upwardly from the upstream side to the downstream side of the movement in the transporting direction, a reverse roller disposed above the downstream side of the movement in the transporting direction for rotating in a reverse direction of the movement in the transporting direction of the belt thus to feed the coins, which have been at the non-aligned state, in a single row at a single layer on the belt, a delivering portion for delivering the coins one by one to the transporting body of the transporting unit, and an input port for receiving the coins one by one transported by the transporting unit.

As set forth in claim 16, in the coin depositing and dispensing machine according to claim 6, a coin input port and the input feeding portion are provided, the coin input port being located at the upper side of the input feeding portion and arranged to serve as the replenish input port for replenishing the machine with the coins.

As set forth in claim 17, in the coin depositing and dispensing machine according to claim 5, the coins identified as abnormal coins by the identifying portion are circulated along the transporting unit and subjected again to the identifying action of the identifying portion.

As set forth in claim 18, in the coin depositing and dispensing machine according to claim 6, the input feeding portion, the identifying portion, the bulk escrow portion, and the diverting gates are at least provided so that the coins delivered from the input feeding portion are transported along the transporting unit at the time of counting the coins before the approval of the deposited coins and subjected to the identifying action of the identifying portion and then the coins identified as normal coins are diverted in the bulk escrow portion by the diverting gate corresponding to the input of the bulk escrow portion while the coins identified as abnormal coins are diverted and returned by the diverting gate corresponding to the returning of the coins.

As set forth in claim 19, in the coin depositing and dispensing machine according to claim 6, the input feeding portion, the identifying portion, the bulk escrow portion, and the diverting gates are at least provided so that the coins delivered from the input feeding portion are transported along the transporting unit at the time of counting the coins before the approval of the deposited coins and subjected to the identifying action of the identifying portion and then the coins identified as normal coins are diverted in the bulk escrow portion by the diverting gate corresponding to the input of the bulk escrow portion while the coins identified as abnormal coins are diverted and sent back to the input feeding portion by the diverting gate corresponding to the input of the input feeding portion from which the abnormal coins are fed to the transporting unit and subjected once again to the identifying action of the identifying portion.

As set forth in claim 20, in the coin depositing and dispensing machine according to claim 18 or 19, the denomination-specific accommodating and ejecting portion is provided so that the coins fed from the bulk escrow portion are transported along the transporting unit at the time of counting the coins before the approval of the deposited coins and subjected to the identifying action of the identifying portion and then the coins identified as normal coins are diverted in the denomination-specific accommodating and ejecting portion by the diverting gate corresponding to the input of the denomination-specific accommodating and ejecting portion while the coins identified as abnormal coins are diverted and returned by the diverting gate corresponding to the returning of the coins.

As set forth in claim 21, in the coin depositing and dispensing machine according to claim 18 or 19, the denomination-specific accommodating and ejecting portion is provided so that the coins fed from the bulk escrow portion are transported along the transporting unit at the time of counting the coins before the approval of the deposited coins and subjected to the identifying action of the identifying portion and then the coins identified as normal coins are diverted in the denomination-specific accommodating and ejecting portion by the diverting gate corresponding to the input of the denomination-specific accommodating and ejecting portion while the coins identified as abnormal coins are diverted and sent back to the input feeding portion by the diverting gate corresponding to the input of the input feeder gate from which the coin are fed to the transporting unit and subjected once again to the identifying action of the identifying portion.

As set forth in claim 22, in the coin depositing and dispensing machine according to claim 6, the coin output port, the identifying portion, the denomination-specific accommodating and ejecting portion, and the diverting gate are at least provided and, in addition, a controller is provided for directing the coins of a denomination, demanded from the outside, to be ejected from the denomination-specific accommodating and ejecting portion to the transporting unit and subjected to the identifying action of the identifying portion and then the coins identified as normal coins are diverted and discharged by one of the two diverting gates which are corresponding to as located above their respective coin output ports disposed at both, left and right, ends of the front side of the machine while the coins identified as abnormal coins are diverted and returned back to the denomination-specific accommodating and ejecting portion by the diverting gate corresponding to the input of the denomination-specific accommodating and ejecting portion and simultaneously directing a number of the coins equal to the number of the abnormal coins to be ejected once again from the denomination-specific accommodating and ejecting portion and fed to the transporting unit.

Effects of the Invention

The coin depositing and dispensing machine according to claim 1 of the present invention is featured that the deposited coins and the dispensing coins are transported by the single annular transporting body supported in the circular form for the circular movement in the transporting direction. Accordingly, the transport mechanism is used for common use between the depositing system and the dispensing system and its arrangement is simplified and downsized, whereby the downsizing of its arrangement can increase the stock size of the coins to be dispensed while its installation layout can permit the dispensing coins to be subjected to the identifying action, hence improving the reliability of the coin accounting task.

The coin depositing and dispensing machine according to claim 2 is featured in addition to the advantage of the coin depositing and dispensing machine defined in claim 1 that the depositing coins and the dispensing coins are transported by the transporting unit which runs in one direction along its circular movement in the transporting direction, whereby the movement of the coins remains in one direction during both the depositing action and the dispensing action and the overall mechanism and control can be simplified.

The coin depositing and dispensing machine according to claim 3 is featured in addition to the advantage of the coin depositing and dispensing machine defined in claim 1 or 2 that the deposited coin sorting and transporting zone for sorting the deposited coins and the dispensing coin receiving and transporting zone are located in different regions in the transporting unit, whereby the action of depositing the coins and the action of dispensing the coins can be carried out with certainty even when the transport mechanism is designed for common use between the depositing system and the dispensing system.

The coin depositing and dispensing machine according to claim 4 is featured in addition to the advantage of the coin depositing and dispensing machine defined in any of claims 1 to 3 that, while the transporting unit has a plurality of the projections provided thereon, each of the coins is accepted between any adjacent two of the projections, whereby the coins can certainly be transported as pushed one by one by their respective projections.

The coin depositing and dispensing machine according to claim 5 is featured in addition to the advantage of the coin depositing and dispensing machine defined in any of claims 1 to 4 that the transporting unit is connected with the coin input port, the coin output port, the identifying portion, the escrow portion, and the accommodating and ejecting portions, whereby the depositing action and the dispensing action can be carried out using the common transporting unit.

The coin depositing and dispensing machine according to claim 6 is featured in addition to the advantage of the coin depositing and dispensing machine defined in any of claims 1 to 4 that at least one or more of the functional units is provided including a coin input port, an input feeding portion, a coin output port, an identifying portion, a denomination-specific escrow portion, a bulk escrow portion, a denomination-specific accommodating and ejecting portion, a bulk accommodating and ejecting portion, a reject box, a recovery cassette, a replenish cassette, and a diverting unit, whereby the depositing action and the dispensing action can be carried out with certainty.

The coin depositing and dispensing machine according to claim 7 is featured in addition to the advantage of the coin depositing and dispensing machine defined in claim 6 that the transporting unit is connected with the functional units for a specific layout, whereby the depositing action and the dispensing action can be carried out using the common transporting unit.

The coin depositing and dispensing machine according to claim 8 is featured in addition to the advantage of the coin depositing and dispensing machine defined in claim 5 that the coins accepted in a non-aligned state by the coin input port are delivered one by one to the transporting unit, transported one by one along the transporting unit, and temporarily stored in the escrow storage portion when the coins have been identified as normal coins by the identifying portion, whereby the depositing system can be implemented in layout by virtue of the transporting unit.

The coin depositing and dispensing machine according to claim 9 is featured in addition to the advantage of the coin depositing and dispensing machine defined in claim 5 that the coins accepted in a non-aligned state by the accommodating and ejecting portion are fed one by one to the transporting unit, transported one by one along the transporting unit, and discharged to the coin output port, whereby the dispensing system can be implemented in layout by virtue of the transporting unit.

The coin depositing and dispensing machines according to claim 10 is featured in addition to the advantage of the coin depositing and dispensing machine defined in claim 5 that the coins accepted in a non-aligned state by the accommodating and ejecting portion are fed one by one to the transporting unit, transported one by one along the transporting unit, and discharged to the coin output port when the coins have been identified as normal coins by the identifying portion, whereby the dispensing system can be implemented in layout by virtue of the transporting unit.

The coin depositing and dispensing machines according to claim 11 is featured in addition to the advantage of the coin depositing and dispensing machine defined in claim 6 that the input feeding portion, the bulk escrow portion, and the denomination-specific accommodating and ejecting portion are all located at the inner side of the transporting unit of a circular form, whereby the dispensing system can readily be implemented in layout by virtue of the transporting unit.

The coin depositing and dispensing machines according to claim 12 is featured in addition to the advantage of the coin depositing and dispensing machine defined in claim 6 that the input feeding portion and the coin output port are located at the front side of the machine while the input feeding portion, the denomination-specific accommodating and ejecting portion, the bulk escrow portion, and the identifying portion are located in a succession from the front side to the rear side, whereby the dispensing system can readily be implemented in layout by virtue of the transporting unit.

The coin depositing and dispensing machines according to claim 13 is featured in addition to the advantage of the coin depositing and dispensing machine defined in claim 12 that the coins fed from the input feeding portion, the denomination-specific accommodating and ejecting portion, and the bulk escrow portion are transported in one direction along the transporting passage of the transporting unit and subjected to the identifying action of the identifying portion, whereby the reliability of the coin accounting task can be improved particularly through the action of identifying the coin.

The coin depositing and dispensing machines according to claim 14 is featured in addition to the advantage of the coin depositing and dispensing machine defined in claim 6 that each of the denomination-specific escrow portion, the bulk escrow portion, the denomination-specific accommodating and ejecting portion, and the escrow accommodating and ejecting portion is arranged for receiving the coins in a non-aligned state on its belt, whereby the storage of the coins can be increased. Also, at the delivering action, the coins which have been at the non-aligned state can be carried in a single row at a single layer on the belt by a combination of the movement in the transporting direction of the belt and the reverse rotating action of the reverse roller and then delivered one by one by the delivering portion to the transporting body in the transporting unit with certainty.

The coin depositing and dispensing machines according to claim 15 is featured in addition to the advantage of the coin depositing and dispensing machine defined in claim 6 that the input feeding portion is arranged for receiving the coins at its input from the transporting unit and carrying the coins in a non-aligned state on the belt, whereby the storage of the coins can be increased. Also, at the delivering action, the coins which have been at the non-aligned state can be carried in a single row at a single layer on the belt by a combination of the movement in the transporting direction of the belt and the reverse rotating action of the reverse roller and then delivered one by one by the delivering portion to the transporting body in the transporting unit with certainty.

The coin depositing and dispensing machines according to claim 16 is featured in addition to the advantage of the coin depositing and dispensing machine defined in claim 6 that the coin input port serve as the replenish input port for replenishing the machine with the coins.

The coin depositing and dispensing machines according to claim 17 is featured in addition to the advantage of the coin depositing and dispensing machine defined in claim 5 that the coins identified as abnormal coins by the identifying portion are circulated along the transporting unit and subjected again to the identifying action of the identifying portion, whereby the coins identified as normal coins by the identifying portion can be prevented from being handled as abnormal coins.

The coin depositing and dispensing machines according to claim 18 is featured in addition to the advantage of the coin depositing and dispensing machine defined in claim 6 that the coins delivered from the input feeding portion are transported along the transporting unit at the time of counting the coins before the approval of the deposited coins and subjected to the identifying action of the identifying portion and then the coins identified as normal coins are diverted in the bulk escrow portion by the diverting gate corresponding to the input of the bulk escrow portion while the coins identified as abnormal coins are diverted and returned by the diverting gate corresponding to the returning of the coins, whereby the overall operation can be speeded up.

The coin depositing and dispensing machines according to claim 19 is featured in addition to the advantage of the coin depositing and dispensing machine defined in claim 6 that the coins delivered from the input feeding portion are transported along the transporting unit at the time of counting the coins before the approval of the deposited coins and subjected to the identifying action of the identifying portion and then the coins identified as normal coins are diverted in the bulk escrow portion by the diverting gate corresponding to the input of the bulk escrow portion while the coins identified as abnormal coins are diverted and sent back to the input feeding portion by the diverting gate corresponding to the input of the input feeding portion from which the abnormal coins are delivered to the transporting unit and subjected once again to the identifying action of the identifying portion, whereby the coins identified as normal coins can be prevented from being handled as abnormal coins.

The coin depositing and dispensing machines according to claim 20 is featured in addition to the advantage of the coin depositing and dispensing machine defined in claim 18 or 19 that the coins delivered from the bulk escrow portion are transported along the transporting unit at the time of counting the coins before the approval of the deposited coins and subjected to the identifying action of the identifying portion and then the coins identified as normal coins are diverted in the denomination-specific accommodating and ejecting portion by the diverting gate corresponding to the input of the denomination-specific accommodating and ejecting portion while the coins identified as abnormal coins are diverted and returned by the diverting gate corresponding to the returning of the coins, whereby the overall operation can be speeded up.

The coin depositing and dispensing machines according to claim 21 is featured in addition to the advantage of the coin depositing and dispensing machine defined in claim 18 or 19 that the coins delivered from the bulk escrow portion are transported along the transporting unit at the time of counting the coins before the approval of the deposited coins and subjected to the identifying action of the identifying portion and then the coins identified as normal coins are diverted in the denomination-specific accommodating and ejecting portion by the diverting gate corresponding to the input of the denomination-specific accommodating and ejecting portion while the coins identified as abnormal coins are diverted and sent back to the input feeding portion by the diverting gate corresponding to the input of the input feeder gate from which the coin are delivered to the transporting unit and subjected once again to the identifying action of the identifying portion, whereby the coins identified as normal coins by the identifying portion can be prevented from being handled as abnormal coins.

The coin depositing and dispensing machines according to claim 22 is featured in addition to the advantage of the coin depositing and dispensing machine defined in claim 6 that the coins of a denomination, demanded from the outside, are ejected from the denomination-specific accommodating and ejecting portion of interest to the transporting unit and subjected to the identifying action of the identifying portion and then the coins identified as normal coins are diverted and discharged by one of the two diverting gates which are corresponding to as located above their respective coin output ports disposed at both, left and right, ends of the front side of the machine while the coins identified as abnormal coins are diverted and returned back to the denomination-specific accommodating and ejecting portion of interest by the diverting gate corresponding to the input of the denomination-specific accommodating and ejecting portion and simultaneously a number of the coins equal to the number of the abnormal coins are ejected once again from the denomination-specific accommodating and ejecting portion to the transporting unit, whereby the reliability of the coin accounting task can be improved.

REFERENCE NUMERALS

Figure 1:
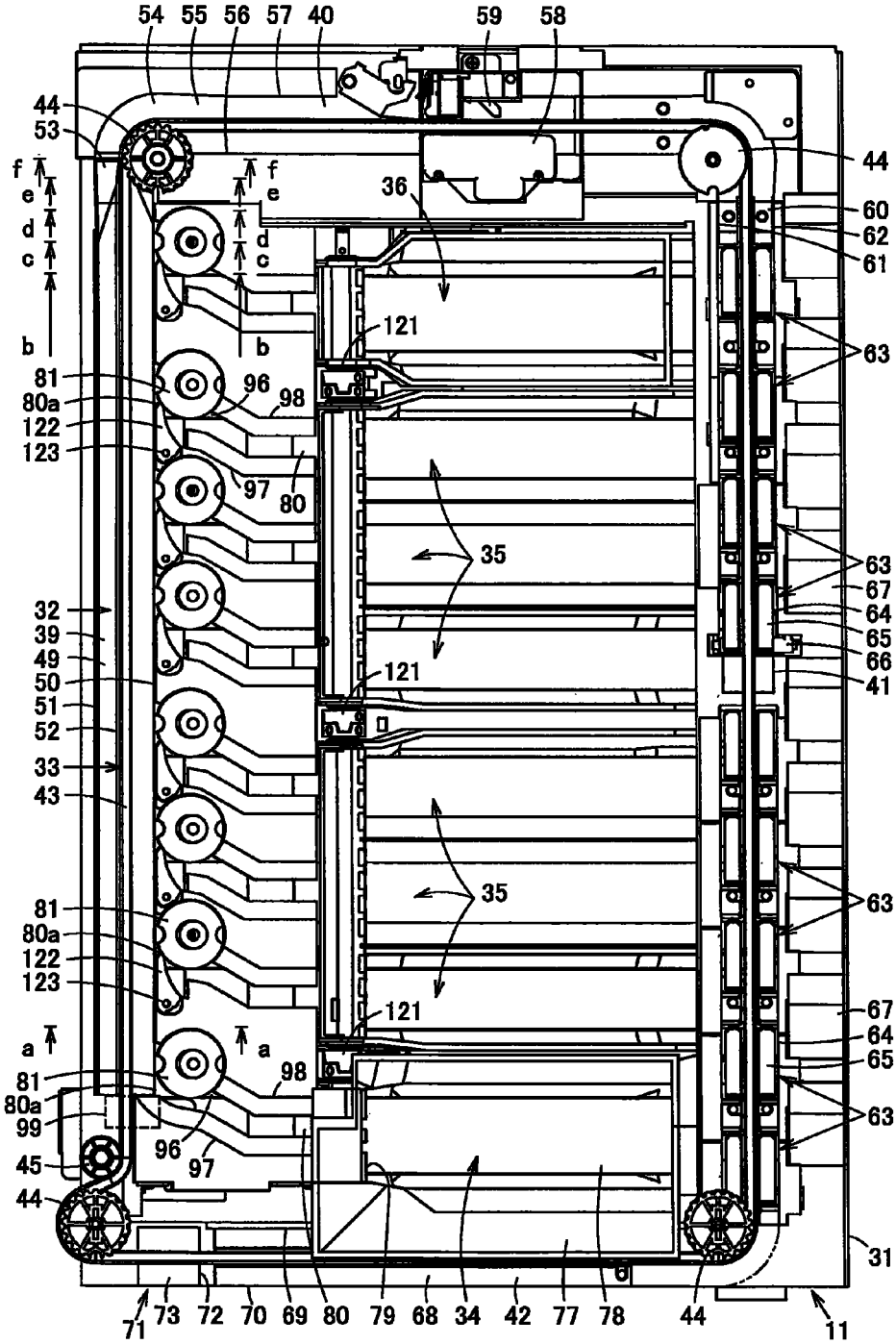
FIG. 1 is a plan view of a coin handling apparatus showing one embodiment of the coin depositing and dispensing machine of the present invention.

15, 16: coin outlet as coin output port
17, 18: coin box as coin output port
33: transporting unit
34: input feeding portion as coin input port
35: denomination-specific accommodating and ejecting portion as accommodating and ejecting portion
36: bulk escrow portion as temporal bulk storage
39: receiving and transporting zone as dispensing coin receiving and transporting region
41: sorting and transporting zone as deposited coin sorting and transporting region
43: transporting belt as transporting body
44: pulley as supporting body
46: projection
58: identifying portion
78: flat belt as belt
79: reverse roller
81: delivering portion
82, 83: rollers
82*a*, 83*a*: axes
90: coin inlet
131: controller
C: coin.

BEST MODE FOR CARRYING OUT THE INVENTION

One embodiment of the present invention will be described referring to the relevant drawings.

Figure 9:
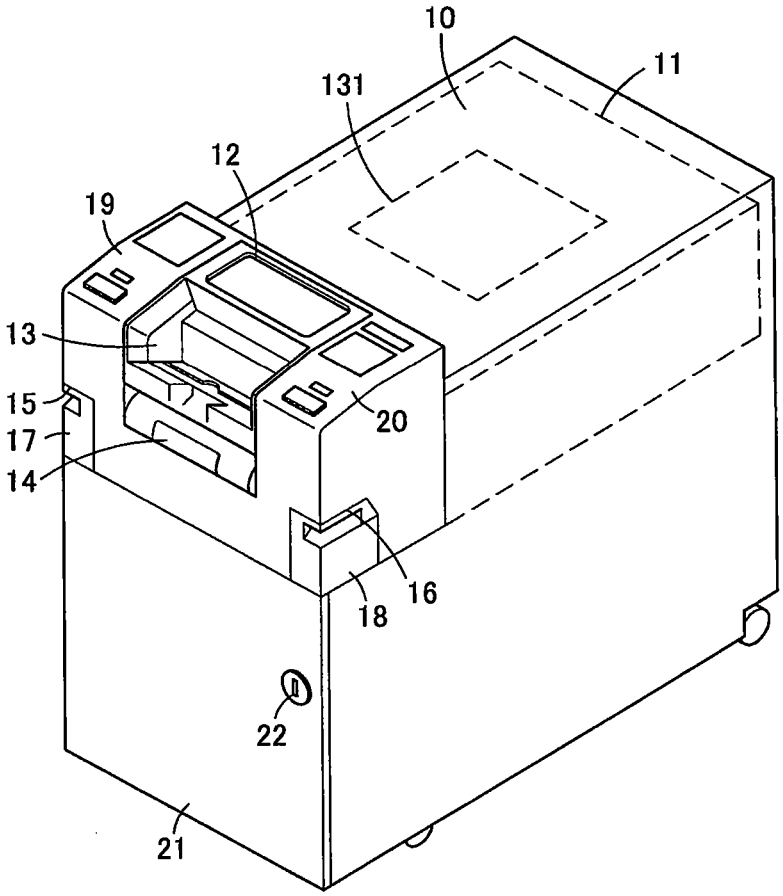
FIG. 9 is a perspective view of the coin handling apparatus with the coin depositing and dispensing machine.

FIG. 9 is a perspective view of a money handling apparatus including a coin depositing and dispensing machine. The money handling apparatus is a combination of a coin depositing and dispensing machine and a bank note depositing and dispensing machine, where a coin handling apparatus 11 which acts as the coin depositing and dispensing machine for receiving and paying out money in coin is disposed at the upper part of a housing 10 while a bank note handling apparatus, not shown, provided for receiving and paying out money in bank notes. The money note handling apparatus is generally installed between two, left and right, tellers at the teller windows of a banking office and connected to two cashing terminals corresponding to the two tellers for common use with the two tellers.

The housing 10 is built in an upright construction having a smaller dimension along the width or the leftward and rightward directions and a longer dimension along the frontward and rearward directions of the housing 10. There are provided a coin input port 12 at substantially the center along the widthwise direction of the upper front side of the housing 10, a bank note input port 13 at the front side of the coin input port 12, and a pair of left coin output port 15 and right coin output port 16 at both the left and right sides of the bank note output port 14 respectively acting as dispensing outlets. The coin output ports 15, 16 are detachably accompanied with coin boxes 17, 18 respectively for receiving and storing coins dispensed from the housing 10.

A pair of left operation unit 19 and right operation unit 20 including arrays of keys and displays are provided at both sides of the coin input port 12 and the bank note input port 13 on the upper side of the housing 10.

A front door 21 is openably provided on the lower front of the housing 10 and equipped with a door key 22 for locking and unlocking the housing 10 with the front door 21 closed. Also, a withdraw cassette, not shown, is detachably provided in the housing 10 closed with the front door 21 for storing the coins withdrawn from the coin handling apparatus 11.

Figure 2:
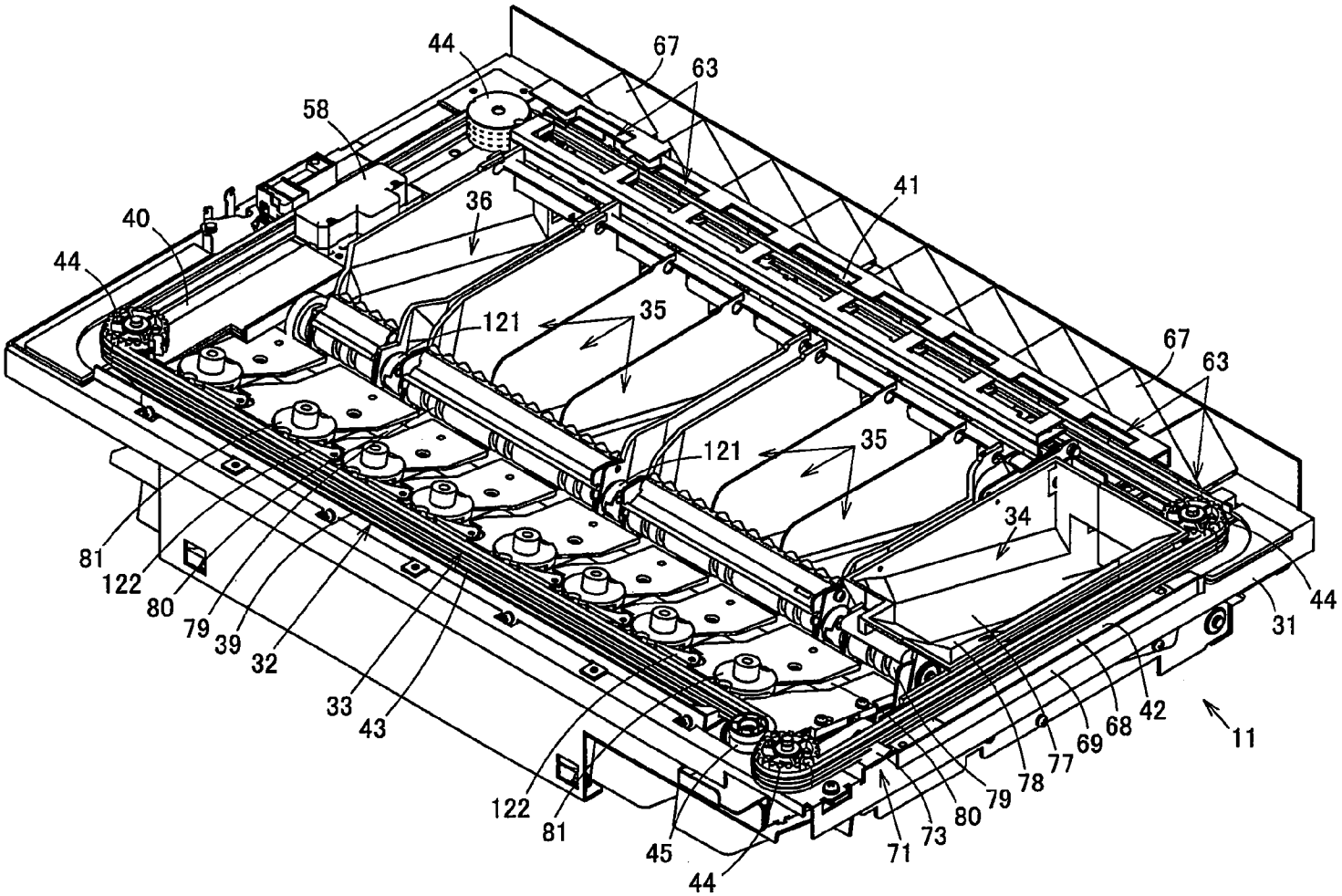
FIG. 2 is a perspective view of the coin handling apparatus.

FIG. 1 is a plan view of the coin handling apparatus and FIG. 2 is a perspective view of the same. The coin handling apparatus 11 has a four-sided frame 31 extended along the frontward and rearward directions and arranged drawable in the frontward direction of the housing 10. The frame 31 has an annular coin passage 32 arranged of substantially a four-sided shape which extends along the four, left, rear, right, and front, sides of the frame 31 and a transporting unit 33 for transporting coins along the coin passage 32 in a transporting or clockwise direction as shown in FIGS. 1 and 2.

A series of functional units are disposed in a row from the front side to the rear side at the inner side of the coin passage 32 and the transporting unit 33, which include an input feeding portion 34 acting as a coin receiver for receiving the coins from the coin input port 12 and feeding one by one the coins to the coin passage 32, denomination-specific accommodating and ejecting portions 35 acting as denomination-specific coin storages for storing the coins for each denomination and ejecting one by one the coins to the coin passage 32, and a bulk escrow portion 36 acting as a temporal coin storage for temporarily storing the coins in bulk after accepted and sorted into denominations and ejecting one by one the coins to the coin passage 32. The input feeding portion 34, the denomination-specific accommodating and ejecting portions 35, and the bulk escrow portion 36 are substantially identical in the fundamental construction which is designed for serving as a coin storage and ejecting unit or a coin storage and ejecting apparatus to feed the coins one by one in a non-aligned state.

The coin passage 32 and the transporting unit 33 are combined to form a transporting region for transporting the coins. Provided in a region extending from the front to the rear along the left side, one of the four sides, of the frame 31 is a receiving and transporting zone 39 where the coins are accepted one by one from the input feeding portion 34, the denomination-specific accommodating and ejecting portions 35, and the bulk escrow portion 36 and transported in a succession. Provided in a region extending from the left to the right along the rear side of the frame 31 is an identifying and transporting zone 40 where the coins are identified while being transported. Provided in a region extending from the rear to the front along the other or right side of the frame 31 is a sorting and transporting zone 41 where the coins are sorted while being transported. Provided in a region extending from the right to the left along the front side of the frame 31 is a dispensing and transporting zone 42 where the coins are transported before delivered to the coin output port 15 at the left side. The receiving and transporting zone 39 forms a dispensed coins receiving and transporting region while the sorting and transporting zone 41 forms a accepted coins sorting and transporting region.

The transporting unit 33 includes a transporting belt 43 provided as a single annular conveyor and pulleys 44 provided as supports for rotatably supporting the transporting belt 43 throughout the coin passage 32. Each of the pulleys 44 is pivotably supported by a vertically extending axis for rotation in the horizontal direction as located at the inner side of the corner of the four-sided shape of the coin passage 32. The transporting belt 43 is mounted along the coin passage 32 in a four-sided form between the pulleys 44. An other pulley 45 is disposed close to one at the left front corner of the pulleys 44 for guiding the transporting belt 43 at the outer side.

The transporting belt 43 is a timing belt having a multiplicity of teeth provided on the inner side thereof while the pulleys 44 are timing pulleys having a multiplicity of teeth provided on the outer side thereof. When one of the pulleys 44 is driven by a driver or namely a motor, not shown, for rotation, it advances the transporting belt 43 in the transporting direction. The transporting belt 43 has a groove provided in the inner side thereof for engagement with a rib portion which is provided on the outer side of each of the pulleys 44, whereby the position along the vertical direction of the transporting belt 43 can be controlled so that the distance between the transporting belt 43 and the transporting side of the coin passage 32 remains greater than the thickness of a thickest type of the coins to be transported.

As shown in FIGS. 3, 4, 7, and 8, a row of projections 46 are mounted at equal intervals along the lengthwise direction on the transporting belt 43 as extended downwardly from the lower side of the transporting belt 43 for pushing and transporting the coins one by one along the coin passage 32. The interval between the projections 46 is determined so that each coin is readily accepted and transported between any two adjacent projections 46 along the transporting direction. Also, a small gap which is smaller than the thickness of a thinnest type of the coins to be transported is provided between the lower side of the projection 46 and the upper side of the coin passage 32. The coins are denoted by C throughout the drawings.

Figure 4:
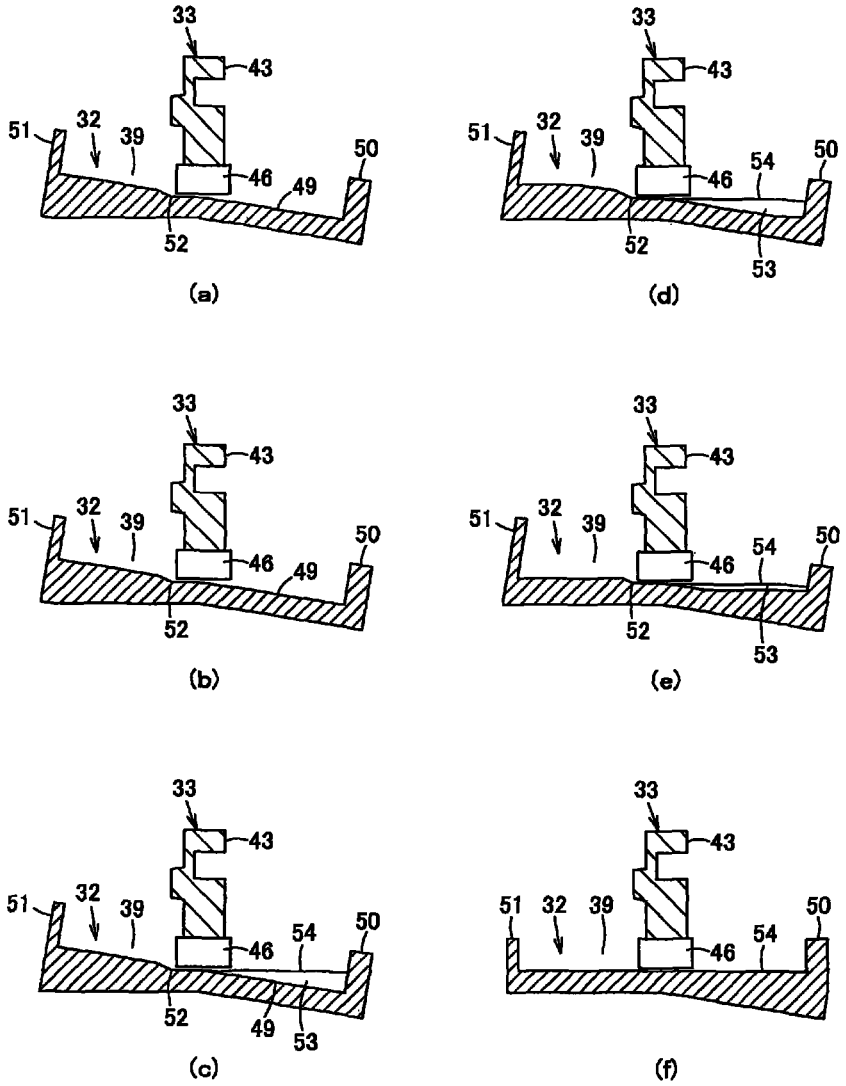
FIG. 4 illustrates a coin passage in the coin handling apparatus, FIG. 4(*a*) being a cross sectional view taken along the line a-a of FIG. 1, FIG. 4(*b*) being a cross sectional view taken along the line b-b of FIG. 1, FIG. 4(*c*) being a cross sectional view taken along the line c-c of FIG. 1, FIG. 4(*d*) being a cross sectional view taken along the line d-d of FIG. 1, FIG. 4(*e*) being a cross sectional view taken along the line e-e of FIG. 1, and FIG. 4(*f*) being a cross sectional view taken along the line f-f of FIG. 1.

The receiving and transporting zone 39 of the coin passage 32 includes, as shown in FIGS. 4(*a*), 4(*b*), and 4(*c*), an inclined passage surface 49 which is inclined in the widthwise direction of the coin passage 32 so that the inner side where the input feeding portion 34, the denomination-specific accommodating and ejecting portion 35, and the bulk escrow portion 36 are installed is lower in the elevation and the outer or opposite side is higher in the elevation, in response to the fact that the coins are upwardly dispensed one by one in an inclined state from the input feeding portion 34, the denomination-specific accommodating and ejecting portions 35, and the bulk escrow portion 36. The width wisely inclined passage surface 49 is defined by an inner guide 50 and an outer guide 50 arranged to guide the outer edge of each coin from both, inner and outer, sides and its width between the inner guide 50 and the outer guide 51 is greater than the diameter of the coin of a largest diameter type to be transported and smaller than two times the diameter of the coin of a smallest diameter type. The inclined passage surface 49 has a grooved clearance 52 provided in the center thereof for remaining not in direct contact with and clearing the projections 46 of the transporting belt 43.

At the end of the downstream side of the receiving and transporting zone 39, the transporting belt 43 has a shifting passage surface 53 provided at the downstream side of the coin output location of the bulk escrow portion 36 for shifting the coin from its inclined position on the inclined passage surface 49 to a horizontal position. As shown in FIGS. 4(*d*), 4(*e*), and 4(*f*), the shifting passage surface 53 is arranged to turn to finally a horizontal passage surface 54 along the transporting direction towards the downstream side by lifting up the inner side of the inclined passage surface 49 from its lower elevation and lowering the outer side of the inclined passage 49 from its higher elevation. More particularly, the transporting passage 32 is shifted from the inclined passage surface 49 at the receiving and transporting zone 39 to the horizontal passage surface 54 at the identifying and transporting zone 40 and the sorting and transporting zone 41, and the dispensing and transporting zone 42 which are located at the downstream side of the receiving and transporting zone 39.

Also as shown in FIGS. 1 and 2, the horizontal passage surface 54 of the coin passage 32 at the identifying and transporting zone 40 extending continuously from the receiving and transporting zone 39 is defined at the upper surface 55 between an inner guide 56 and an outer guide 57. An identifying portion 58 is disposed at the inner guide 56 at the inner side of the coin passage 32 and the transporting unit 33 for identifying the denomination of the coins being transported through detecting their material and diameter. At the other side or outer side of the coin passage 32 and the transporting-unit 33, a deflecting member 59 is disposed opposite to the identifying portion 58 for pushing the coins being transported in the identifying and transporting zone 40 towards the inner guide 56 or the identifying portion 58 side. The deflecting member 59 may be made of a resin material which is pivotably mounted at the proximal end on a vertical axis for pivoting towards the outer guide 57 and remains urged towards the inner side by a spring so that its distal end projecting into the coin passage 32.

At the sorting and transporting zone 41 extending continuously from the identifying and transporting zone 40, the horizontal passage surface 54 of the coin passage 32 is defined at the upper surface 60 between an inner guide 61 and an outer guide 62. Sorting units 63 are disposed at the sorting and transporting zone 41 for sorting and selectively directing the coins being transported to the bulk escrow portion 36, the denomination-specific accommodating and ejecting portions 35, the input feeding portion 34, and the right coin output port 16. Each of the sorting portion 63 has a switching opening 64 provided therein to face the passage surface 60 and accept the coins dropping down from the passage surface 60 and a diverting gate 65 located beneath the switching opening 64 for selectively directing the coins. The diverting gate 65 is arranged for standing separately at both sides of the transporting belt 43 for permitting no direct contact with the transporting belt 43 and pivotably mounted at the downstream side of the transporting direction on a horizontally extending pivot axis 66. More particularly, the diverting gate 65 is driven by a solenoid 67 acting as the sorting portion driver for moving between two positions, the closing position where the diverting gate 65 is set horizontal to shut up the switching opening 64 and the opening position where the distal end at the upstream side of the transporting direction of the diverting gate 65 is lifted up to open the switching opening 64. When the diverting gate 65 is at the closing position, the coins being transported by the transporting belt 43 are passed through the switching opening 64 and the diverting gate 65. When the diverting gate 65 is at the opening position, the coins being transported by the transporting belt 43 drop down into the switching opening 64 as being forcibly guided by the diverting gate 65.

A shifting means, not shown, is disposed beneath the switching opening 16 at the diverting gate 63 on the right for guiding and directing the coins selected by the action of the diverting gate 63 to the right coin output port 16 or a recovery cassette located beneath the housing 10.

At the dispensing and transporting zone 42 of the coin passage 32 extending continuously from the sorting and transporting zone 41, the horizontal passage surface 54 of the coin passage 32 is defined at the upper surface 68 between an inner guide 69 and an outer guide 70. A sorting portion 71 is disposed at the end of the downstream side of the dispensing and transporting zone 42 for selectively directing the coins to the left coin output port 15. The sorting portion 71 has a switching opening 72 provided therein to face the passage surface 68 and accept the coins dropping down from the passage surface 68 and a diverting gate 73 disposed at its stationary location for directing the coins into the switching opening 72.

Also, a set of sensors are disposed over the coin passage 32 for detecting the position of each of the coins being transported on the transporting belt 43.

As shown in FIGS. 1, 2, 3, and 5, the receiving and ejecting unit 34 includes a storage frame 77 for receiving the coins in a non-aligned state from the coin input port 12 through which the coins are input into or from the coin passage 32, a flat, endless belt 78 disposed on the bottom of the storage frame 77 along the widthwise direction from left to right of the coil handling apparatus 11, a reverse roller 79 disposed above the flat belt 78 at the downstream side of the movement in the feeding direction of the flat belt 78 for rotating in a reverse direction of the movement in the feeding direction of the flat belt 78 to align in a single row at a single layer and deliver the coins which have been accepted at non-aligned state, a feeder passage 80 for feeding the coins passed under the reverse roller 79 to the receiving and transporting zone 39 of the coin passage 32, and a delivering portion 81 for feeding the coins one by one from the feeder passage 80 to the projections 46 of the transporting belt 43.

The flat belt 78 is mounted between a roller 82 at the upstream side of the movement in the feeding direction and a roller 83 at the downstream side of the movement in the feeding direction which are pivotably mounted on two horizontally extending axes 82*a*, 82*b* respectively so that its inclined transporting surface 84 extends linearly and upwardly from the upstream side to the downstream side of the movement in the feeding direction. The width of the flat belt 78 is arranged greater than the diameter of the coin and smaller than two times the diameter of the coin.

The roller 83 at the downstream side of the movement in the feeding direction of the flat belt 78 is located in the proximity of the innermost end of the inclined passage surface 49 of the coin passage 32 in the receiving and ejecting zone 39. The inclined transporting surface 84 of the flat belt 78 and the inclined passage surface 49 of the coin passage 32 extend at the same angle, whereby the coins fed at their inclined state from the inclined transporting surface 84 of the flat belt 78 can be accepted at the inclined state by the inclined passage surface 49 of the coin passage 32.

In addition, a group of rollers 85 and a driving roller 86 are disposed beneath the inclined transporting surface 84 of the flat belt 78 for supporting and driving the flat belt 78. One of the rollers 85 of the group, denoted by 85*a*, is located at the downstream side and the lower side of the roller 83 at the downstream side of the movement in the feeding direction while the flat belt 78 is downwardly inclined from the roller 83 to the roller 85*a*. The driving roller 86 is driven by a motor 87 which serves as a common driving unit for conducting the rotating actions of the input feeding portion 34, the denomination-specific accommodating and ejecting portions 35, and the bulk escrow portion 36. This allows the motor 87 to rotate the flat belt 78 for the movement in feeding direction.

The storage frame 77 includes a pair of lateral sides 88 located at both sides along the widthwise direction of the flat belt 78 and an end side 89 located at the upstream side of the movement in the feeding direction. The sorting portion 63 at the sorting and transporting zone 41 of the coin passage 32 is located above the storage frame 77 at the upstream side of the movement in the feeding direction. The storage frame 77 thus has a coin inlet 90 provided at the coin receiving location thereof for receiving the coins selectively directed by the sorting portion 63.

A guide member 91 is disposed in the storage frame 77 for guiding the inclined transporting surface 84 of the flat belt 78 while acting as a part of the storage frame 77. The guide member 91 has a flat supporting surface 92 for supportingly holding the inclined transporting surface 84 of the flat belt 78 at a desired level and a pair of guide portions 93 extended along both sides of the flat belt 78 respectively. Each of the guide portions 93 has a guide surface 95 extended upwardly from its guide side edge 94, which faces one side of the flat belt 78, to the outer side end opposite to the flat belt 78 side. The guide surface 95 is consisted mainly of a flat surface 95*a* extended from the guide side edge 94 in parallel with the inclined transporting surface 84 of the flat belt 78 and a tilted surface 95*b* extended upwardly at an angle from the flat surface 95*a* to the outer side end.

The height of the guide side edge 94 of the guide portion 93 is sized lower than the inclined transporting surface 84 at the upper side of the flat belt 78 and higher than the lower side of the flat belt 78 or falls within the thickness of the flat belt 78 throughout the area A1 of the flat belt 78 which extends substantially between the upstream side of the reverse roller 79 and the downstream side of the location just beneath the coin inlet 90 along the movement in the feeding direction. Meanwhile, throughout the area A2 which extends beneath the coin inlet 90 in the upstream side of the movement in the feeding direction and throughout the area A3 where the reverse roller 79 is located in the downstream side of the movement in the feeding direction, the height of the guide side edge 94 is sized higher than the inclined transporting surface 84 of the flat belt 78.

Also, the reverse roller 79 is spaced from the inclined transporting surface 84 of the flat belt 78 at the coin output region of the storage frame 77 so that one coin at the thickness placed on the inclined transporting surface 84 can pass through between the reverse roller 79 and the flat belt 78. The reverse roller 79 is driven by the motor 87, which commonly conducts the actions of the input feeding portion 34, the denomination-specific accommodating and ejecting portions 35, and the bulk escrow portion 36, for rotation in a reverse of the movement in the feeding direction of the flat belt 78, whereby the coins at non-aligned state can be aligned in a single row at a single layer and carried outwardly on the flat belt 78.

The feeder passage 80 extends in the downstream side along the movement in the feeding direction of the reverse roller 79 over the inclined transporting surface 84 of the flat belt 78 and a passage plate 96 which is disposed at one end of the flat belt 78. The passage plate 96 is arranged flush with the inclined transporting surface 84 of the flat belt 78 and inclined at the same angle. A pair of guide members 97, 98 are disposed at both sides of the feeder passage 80 for guiding the outer edge of the coins. The guide members 97, 98 are positioned diagonally for biasing the movement of the coins towards one side to align with the transporting direction of the coin passage 32.

In the feeder passage 80, a debris removing opening 99 is provided at the downstream side along the feeding direction of the guide member 97, which biases the movement of the coin towards one side, for removing downwardly any debris transported together with the coins by the flat belt 78. The debris removing aperture 99 is located between the guide member 97, the downwardly sloping portion of the flat belt 78 extending from the roller 83 to the roller 85*a*, and the starting end at the inclined passage surface 49 of the coin passage 32. A debris recovery box is disposed beneath the debris removing aperture 99 for recovering and storing removed debris.

The inner guide 50 is not present at the junction between the coin passage 32 and the coin feeder output end 80*a* of the feeder passage 80 so that the coins fed out from the coin feeder output end 80*a* of the feeder passage 80 can be accepted by the inclined passage surface 49 of the coin passage 32.

The delivering portion 81 has a cam 102 of a round shape pivotably mounted on an axis 101, which is arranged vertical to the inclined transporting surface 84 of the flat belt 78, for rotating motion along the horizontal direction as located at the guide member 97 side of the feeder passage 80 and at the output end of the feeder passage 80 communicating with the downstream side of the transporting direction of the coin passage 32. The cam 102 is driven by a pulse motor 103 acting as the feeder driver for rotating motion in the direction of coin feeding (in the clockwise direction in the drawing).

Figure 7:
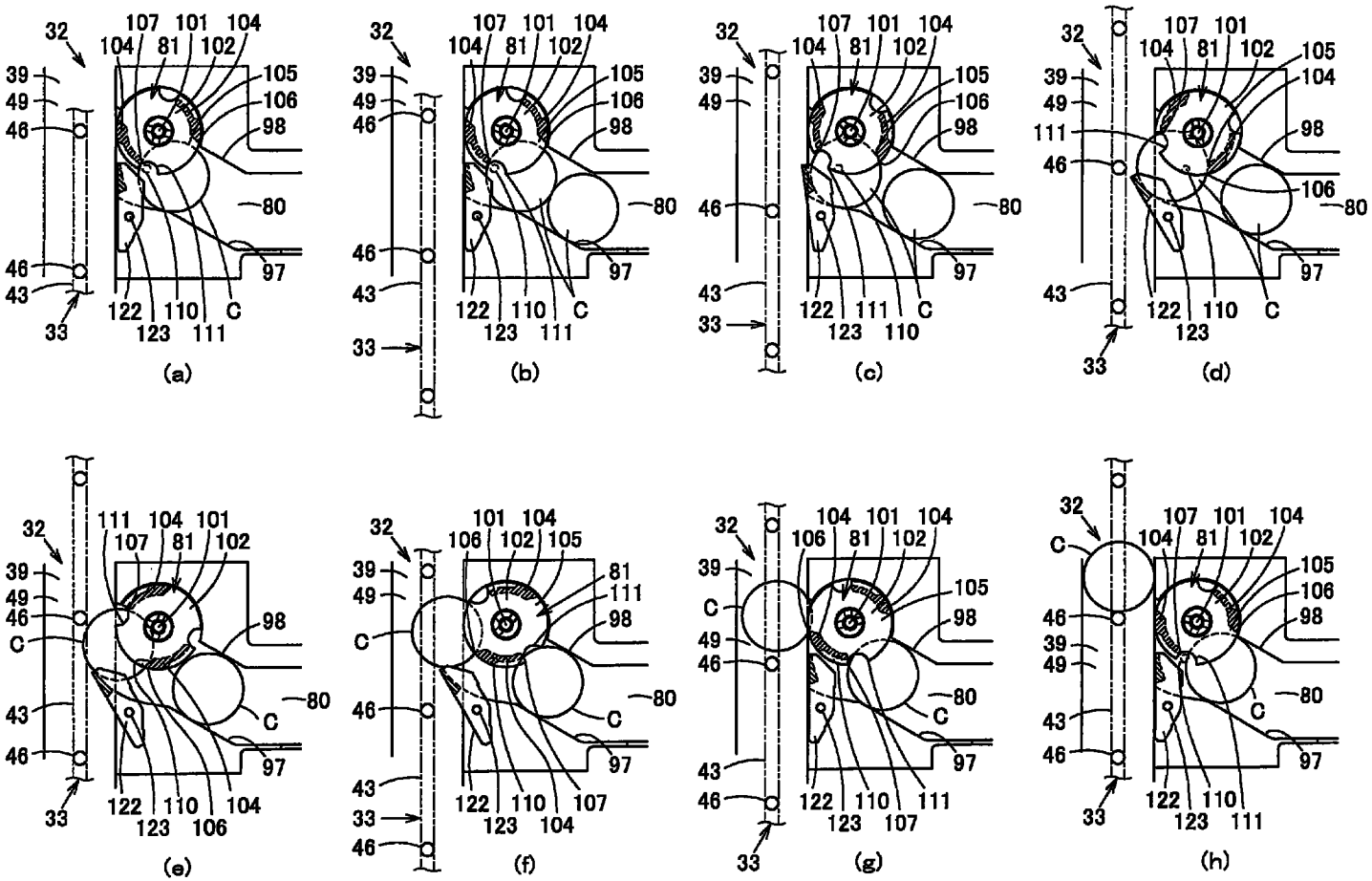
FIG. 7 illustrates the movement of large-diameter type coins at a delivering portion in the coin handling apparatus, FIGS. 7(*a*) to 7(*h*) being explanatory plan views of the movement in a succession.
Figure 8:
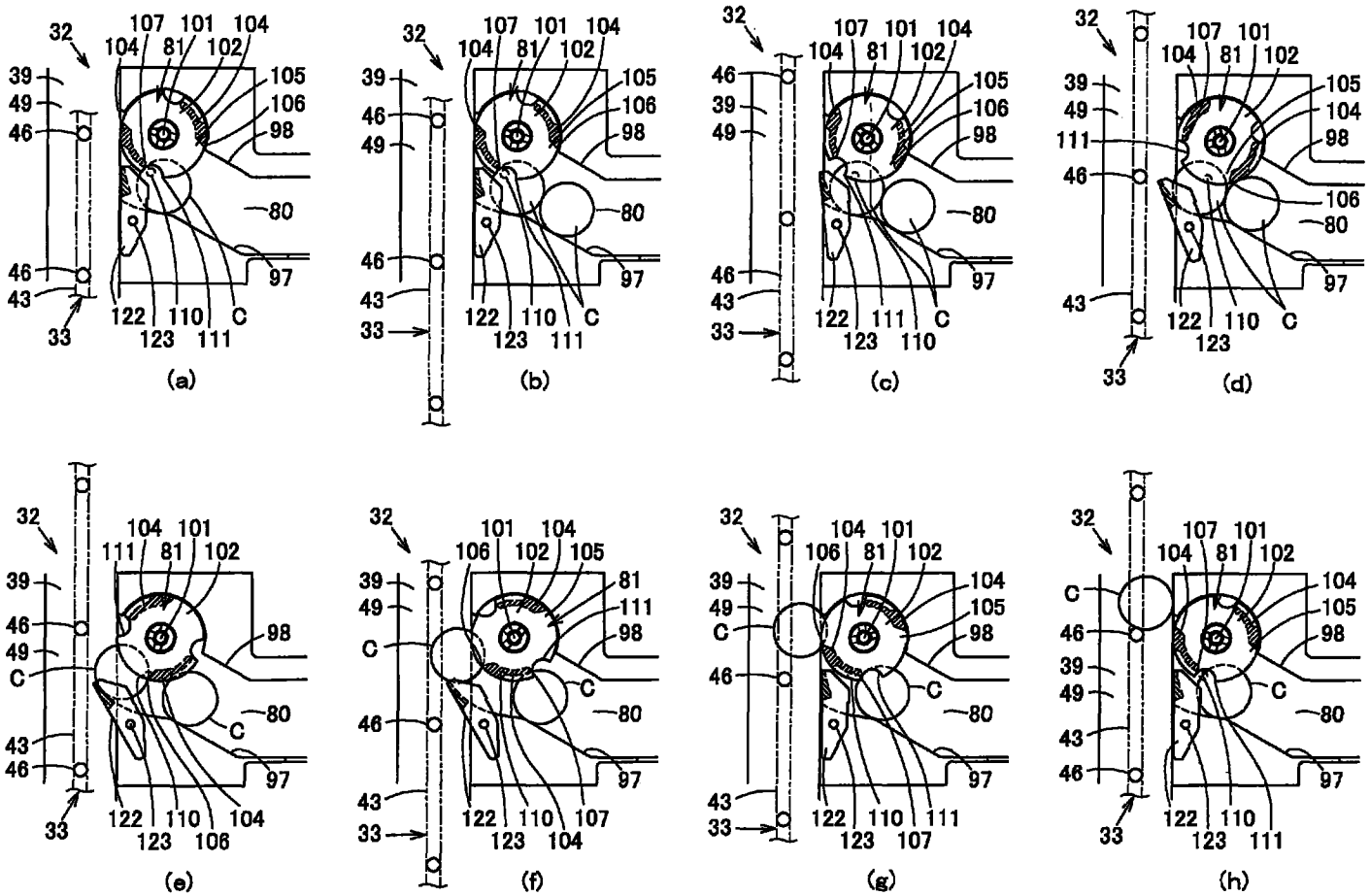
FIG. 8 illustrates the movement of small-diameter type coins at the delivering portion in the coin handling apparatus, FIGS. 8(*a*) to 8(*h*) being explanatory plan views of the movement in a succession.

The cam 102 has, as shown in FIGS. 7 and 8, a pair of downwardly projected portions 104 provided at symmetry relationship along the circumferential edge thereof and a recessed portion 105 provided between the projected portions 104. The projections 104 are spaced from the inclined transporting surface 84 of the flat belt 78 thus to allow no entering of the coins between the projections 104 and the inclined transporting surface 84. The distance between the recessed portion 105 and the inclined transporting surface 84 and the width of the recessed portion 105 between the two projected portions 104 of the cam 102 are so sized as to accept and seize each of the coins.

Each of the projected portions 104 acts as a pushing portion 106 at one end, which faces the direction of rotation, for pushing the coin seized by the recessed portion 105 to the corresponding projection 46 of the transporting belt 43 and also as a stopper portion 107 at the other end, which faces a reverse of the direction of rotation, and the other outer edge for interrupting the movement of the succeeding coin until the timing of feeding the succeeding coin comes after the feeding of the preceding coin. Accordingly, the delivering portion 81 functions as a stopper means for interrupting the feeding of the coins from the input feeding portion 34.

As shown in FIG. 7(*a*) or 8(*b*), the cam 102 is controlled to turn 180 degrees from its start position where one coin has moved into one half of the recessed portion 105 and remains interrupted direction by one of the stopper portions 107 as is timed with the action of feeding the preceding coin to a corresponding one of the projections 46 of the transporting belt 43. The cam 102 thus comes to a stop position or another start position where the succeeding coin has moved into the other half of the recessed portion 105 and remains interrupted direction by the other stopper portion 107 and stands by for starting the succeeding action of feeding. The start position of the cam 102 is detected by a start position detecting means or namely an optical sensor 109 measuring the transmission of light through one of two notches provided in the circumferential edge of a detection disk 108 which is mounted on the axis 101.

Also, another optical sensor 110 is disposed at one side of the flat belt 78 in the feeder passage 80 for detecting the moving in of the coin into the recessed portion 105 of the cam 102. Correspondingly, the cam 102 has a notch 111 provided therein for allowing the sensor 110 to detect the presence of the coin at the start position.

As shown in FIGS. 1 and 2, the denomination-specific accommodating and ejecting portions 35 and the bulk escrow portion 36 are fundamentally identical in the construction to the input feeding portion 34 and include storage frames 77, flat belts 78, reverse rollers 79, feeder passages 80, and delivering portions 81. This allows the denomination-specific accommodating and ejecting portions 35 and the bulk escrow portion 36 to eject the coins one by one to the receiving and transporting zone 39 of the coin passage 32 while enabling to accept and store the coins which have been selectively sorted by the sorting portions 63 disposed in the sorting and transporting zone 41 of the coin passage 32. Therefore, the construction will be explained in no more detail while the description of different points follows.

Three of the denomination-specific accommodating and ejecting portions 35 having the storage frames 77, the flat belts 78, and the reverse rollers 79 are assembled to a single unit. A total of two units are provided in the coin handling apparatus 11. The rollers 86 for driving the input feeding portion 34, the denomination-specific accommodating and ejecting portions 35, and the bulk escrow portion 36 are joined together by couplings not shown while the reverse rollers 79 are joined together by couplings 121. This allows the common motor 87 to drive the flat belts 78 and the reverse rollers 79 at once in the input feeding portion 34, the denomination-specific accommodating and ejecting portions 35, and the bulk escrow portion 36.

Figure 5:
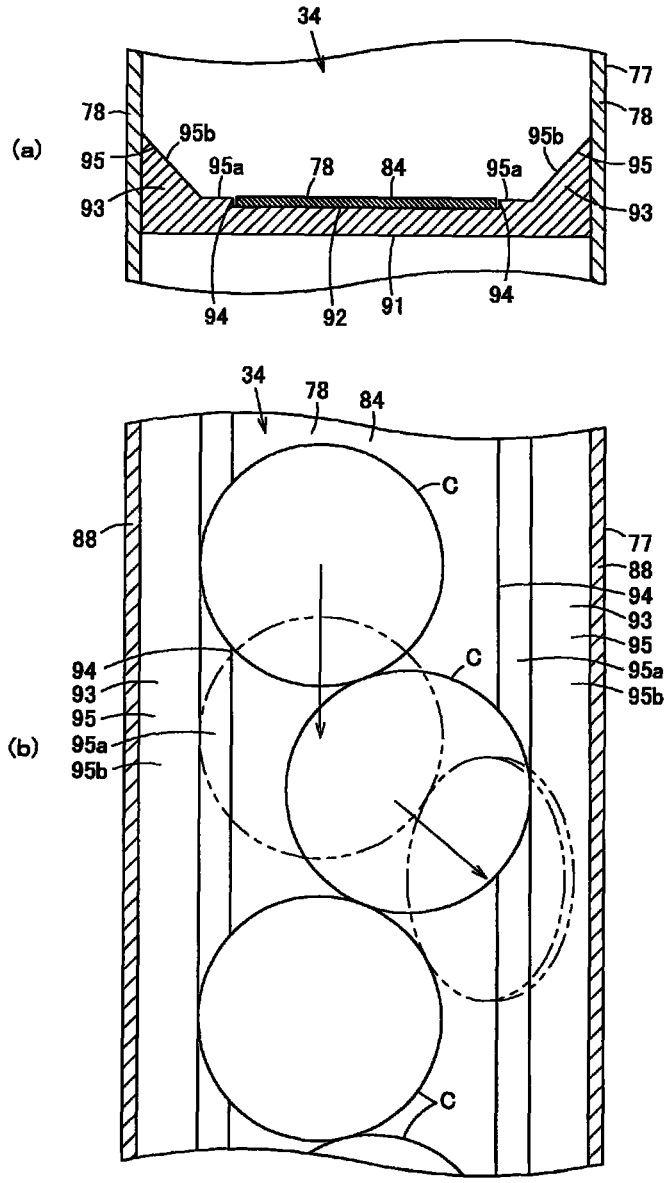
FIG. 5 illustrates an input feeding portion in the coin handling apparatus, FIG. 5(*a*) being a cross sectional view and FIG. 5(*b*) being a plan view.
Figure 6:
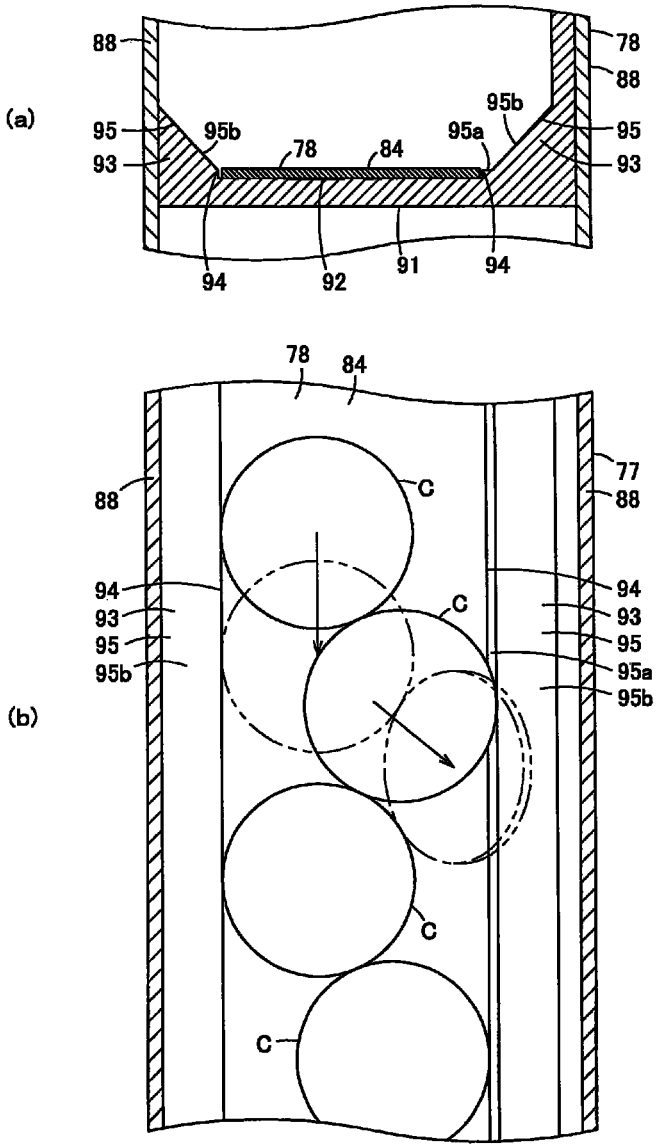
FIG. 6 illustrates a denomination-specific accommodating and ejecting portion for small-diameter type coins in the coin handling apparatus, FIG. 6(*a*) being a cross sectional view and (b) being a plan view.

As the primary region of the input feeding portion 34 is illustrated in FIG. 5, its arrangement is equal to those in the denomination-specific accommodating and ejecting portions 35 for large-diameter type coins and the bulk escrow portion 36. FIG. 6 illustrates the primary region of the denomination-specific accommodating and ejecting portion 35 for small-diameter type coins, where the width of the flat belt 78 is equal, the width of the storage frame 77 is smaller, and the flat surface 95*a* of the guide portion 93 is shorter or not provided as compared with the denomination-specific accommodating and ejecting portion 35 for large-diameter type coins. For example, the coins of Japanese currency are classified into a five-yen coin, a ten-yen coin, a hundred-yen coin, and a five-hundred-yen coin as the large-diameter type coins and a one-yen coin and a fifty-yen coin as the small-diameter type coins.

As shown in FIGS. 7 and 8, a guide lever 122 acting as a guiding member is disposed at the coin feeder output end 80*a* of the feeder passage 80, along which the coins are fed out to the coin passage 32 from the denomination-specific accommodating and ejecting portions 35 and the bulk escrow portion 36, for opening and closing the coin feeder output end 80*a* in synchronization with the movement of the coins. The guide lever 122 is arranged for pivotal movement about an axis 123, which is disposed at the upstream side along the feeding direction of the coin passage 32, between the position of closing the coin feeder output end 80*a* and the opening position with its distal end extending into the coin passage 32 and remains urged by a spring, not shown, in a direction for closing the coin feeder output end 80*a*. The guide lever 122 when remains at the position of closing the coin feeder output end 80*a* directs the coins to be transported from the upstream side to the downstream side along the coin passage 32. When the guide lever 122 is pushed by the coin being fed outwardly from the coin feeder output end 80*a*, it extends into the coin passage 32 as resisting against the urging force of the spring, thus permitting the coin to feed from the coin feeder output end 80*a* to the coin passage 32.

The coin teller machine also includes a controller unit 131 for controlling the actions of the coin handling apparatus 11 which include the foregoing action of handling the coins.

The actions of the coin handling apparatus 11 will be described in more detail.

The description starts with the action of depositing the coins.

When commanded by one of the two, left and right, tellers operating its terminal for starting the action of depositing the coins, the coins are input into the coin input port 12 and accepted by the input feeding portion 34. As the deposition of the coins to the input feeding portion 34 is detected by a sensor, not shown, detecting the presence of the coins in the input feeding portion 34, the action of handling the coins starts.

In the input feeding portion 34, the flat belt 78 starts moving in the feeding direction and simultaneously the reverse roller 79 rotates in a reverse direction in the feeding direction. The coins accepted in a non-aligned state are aligned in a single row at a single layer on the flat belt 78 and transported to the feeder passage 80. By the action of the delivering portion 81, the coins are delivered one by one from the feeder passage 80 to the corresponding projections 46 of the transporting belt 43 which is driven along the receiving and transporting zone 39 of the coin passage 39.

Since the debris removing aperture 99 is provided at the downstream side along the feeding direction in the guide member 97 side of the feeder passage 80 towards which the coins are moved aside, any debris carried together with the coins on the flat belt 78 along the feeder passage 80 can be removed downwardly through the debris removing aperture 99. Accordingly, the coin passage 32 can favorably be prevented from receiving any debris, thus avoiding undesired malfunctions which result from the presence of debris.

The coins are then transported by the corresponding projections 46 of the transporting belt 43 from the receiving and transporting zone 39 to the identifying and transporting zone 40 of the coin passage 32 where their quality is examined by the identifying portion 58 at the identifying and transporting zone 40. Since the coins being transported in different positions along the widthwise direction of the coin passage as pushed by the corresponding projections 46 of the transporting belt 43 are dislocated towards the identifying portion 58 by the action of the deflecting member 59, their quality can accurately be identified with the identifying portion 58. Moreover, as the deflecting member 59 is made of a resin material, it will hardly interrupt the identifying action of the identifying portion 58 which may generally employ a magnetic sensor.

When having been qualified by the identifying portion 58, the coins are further transported from the identifying and transporting zone 40 to the sorting and transporting zone 41 where they are selectively picked up by the sorting portion 63 corresponding to the bulk escrow portion 36 and stored in the bulk escrow portion 36.

At the time, as the delivering portions 81 in the denomination-specific accommodating and ejecting portions 35 and the bulk escrow portion 36 remain inactivated for feeding the coins, they allow no coins to be fed even if the flat belts 78 or the reverse rollers 79 are turned on.

When the coins are disqualified and identified as rejected coins by the identifying portion 58 and the action of repeating the identifying action for rejected coins has been preset, they are transported from the identifying and transporting zone 40 to the sorting and transporting zone 41 and sent back to the input feeding portion 34 by the action of the sorting portion 63 corresponding to the bulk escrow portion 36. This allows the coins to be fed from the input feeding portion 34 to the coin passage 32 and examined once again by the identifying portion 58. The action of repeating the identifying action will hence minimize the number of the normal coins to be identified unfavorably as rejected coins.

Such rejected coins will be removed when they only are present in the input feeding portion 34 and the coin passage 32 and their presence is detected more than a predetermined number of times by the identifying portion 58 or the action of repeating the identifying action has been not preset. More particularly, when the rejected coins are to be handled by the teller at the right side and have been transported from the identifying and transporting zone 40 to the sorting and transporting zone 41, they are picked up by the sorting portion 63 disposed at the end of the downstream side and corresponding to the right coin output port 16 and discharged to the right coin output port 16. On the other hand, when the rejected coins are to be handled by the teller at the left side, they are transported from the sorting and transporting zone 41 to the dispensing and transporting zone 42 and picked up by the sorting portion 71 corresponding to the left coin output port 15 and discharged to the left coin output port 15. The rejected coins discharged to the two coin output ports 15, 16 are then recovered in the output boxes 17, 18 which are then withdrawn from the housing 10 for removal of the rejected coins.

When all the coins have been fed from the input feeding portion 34, the presence of no coins has been detected with the sensor, and the identifying portion 58 has failed to detect the presence of the coins for a specific length of time, the judgment of completing the action of counting the number of the coins to be handled is issued and the action of the transporting belt 43, the flat belts 78, and the reverse rollers 79 are canceled.

This is followed by approving the number of the coins and, if the replenishing with coins is commanded, filling the denomination-specific accommodating and ejecting portions with the coins of required denominations. The coins are also fed one by one from the bulk escrow portion 36 by the same action as of the input feeding portion 34 and delivered by the delivering portion 81 to the corresponding projections 46 of the transporting belt 43 which runs through the receiving and transporting zone 39 of the coin passage 32.

The coins pushed by the projections 46 of the transporting belt 43 are transported from the receiving and transporting zone 39 to the identifying and transporting zone 40 of the coin passage 32 where they are identified by the identifying portion 58.

When the coins have been qualified by the identifying portion 58, they are further transported from the identifying and transporting zone 40 to the sorting and transporting zone 41 where they are sorted and selectively picked up by the sorting portions 63 corresponding to their respective denomination-specific accommodating and ejecting portions 35 for storage in the denomination-specific accommodating and ejecting portions 35.

When the coins have been identified as rejected coins by the identifying portion 58, e.g., the denomination of coins has hardly been identified, and the action of repeating the identifying action has been preset, they are transported from the identifying and transporting zone 40 to the sorting and transporting zone 41 where they are selectively picked up by the sorting portion 63 corresponding to the input feeding portion 34 and returned to the input feeding portion 34. This allows the rejected coins to be fed from the input feeding portion 34 to the coin passage 32 and examined once again by the identifying portion 58. The action of repeating the identifying action will hence minimize the number of the normal coins to be identified unfavorably as rejected coins.

The rejected coins will be removed when they only are present through the input feeding portion 34 and the coin passage 32 and their presence is detected more than a predetermined number of times by the identifying portion 58 or the action of repeating the identifying action has been not preset. More particularly, when the rejected coins are to be handled by the teller at the right side, they are transported from the identifying and transporting zone 40 to the sorting and transporting zone 41, picked up by the sorting portion 63 disposed at the end of the downstream side and corresponding to the right coin output port 16, and discharged to the right coin output port 16. On the other hand, when the rejected coins are to be handled by the teller at the left side, they are further transported from the sorting and transporting zone 41 to the dispensing and transporting zone 42, picked up by the sorting portion 71 corresponding to the left coin output port 15, and discharged to the left coin output port 15. The rejected coins discharged to the two coin output ports 15, 16 are then recovered in the output boxes 17, 18 which are then withdrawn from the housing 10 for removal of the rejected coins.

If the number of the coins counted is not approved and their returning is commanded, the coins are returned back to the bulk escrow portion 36. The returned coins are then fed one by one from the bulk escrow portion 36 by the same action as that of the input feeding portion 34 and delivered by the delivering portion 81 to the corresponding projections 46 of the transporting belt 43 which runs through the receiving and transporting zone 39 of the coin passage 32.

The returned coins are pushed by the projections 46 of the transporting belt 43 and transported from the receiving and transporting zone 39 to the identifying and transporting zone 40 of the coin passage 32 where they are identified once again by the identifying portion 58.

The returned coins subjected to the identifying portion action are further transported from the identifying and transporting zone 40 to the sorting and transporting zone 41. When the returned coins are to be handled by the teller at the right side, they are selectively picked up by the sorting portion 63 disposed at the end of the downstream side and corresponding to the right coin output port 16 and discharged to the right coin output port 16. On the other hand, when the returned coins is to be handled by the teller at the left side, they are transported from the sorting and transporting zone 41 to the dispensing and transporting zone 42 and selectively picked up by the sorting portion 71 corresponding to the left coin output port 15 and discharged to the left coin output port 15. The returned coins discharged to the two coin output ports 15, 16 are then recovered in the output boxes 17, 18 which are then withdrawn from the housing 10 for recovery of the returned coins.

Then, the action of dispensing the coins will be described.

When demanded by one of the two, left and right, tellers operating its terminal for entering the amount, the denomination, and the number of coins to be dispensed, the action of dispensing the coins is commenced.

The coins of the demanded denomination are fed one by one from the corresponding denomination-specific accommodating and ejecting portion 35 of interest by the same action as of the input feeding portion 34 described previously and delivered by the delivering portion 81 to their respective projections 46 of the transporting belt 43 which runs through the receiving and transporting zone 39 of the coin passage 32. The other denomination-specific accommodating and ejecting portion 35 of no interest and the denomination-specific accommodating and ejecting portion 35 of interest which has been exhausted after all the coins stored were fed are inactivated with their delivering portions 81 canceling the action of feeding the coins even when the flat belts 78 and the reverse rollers 79 are continuously rotated.

The coins to be dispensed are then pushed by the projections 46 of the transporting belt 43 and transported from the receiving and transporting zone 39 to the identifying and transporting zone 40 of the coin passage 32 where they are identified by the identifying portion 58 at the identifying and transporting zone 40.

The coins which have been qualified as normal coins by the identifying portion 58 are further transported from the identifying and transporting zone 40 to the sorting and transporting zone 41. When the coins are to be demanded by the teller at the right side, they are selectively picked up by the sorting portion 63 disposed at the end of the downstream side and corresponding to the right coin output port 16 and discharged to the right coin output port 16. Similarly, when the coins is to be demanded by the teller at the left side, they are transported from the sorting and transporting zone 41 to the dispensing and transporting zone 42 and selectively picked up by the sorting portion 71 corresponding to the left coin output port 15 and discharged to the left coin output port 15. The coins discharged to the two coin output ports 15, 16 are then collected in the output boxes 17, 18.

When the coins have been identified as abnormal coins by the identifying portion 58, e.g., the denomination of coins has hardly been identified, they are transported from the identifying and transporting zone 40 to the sorting and transporting zone 41 where they are selectively picked up by the sorting portion 63 corresponding to the input feeding portion 34 and returned to the input feeding portion 34. The loss of the coins is then compensated by the coins being ejected again the coins from the denomination-specific accommodating and ejecting portion 35 of interest and delivered to the coin passage 32.

As the total amount of the coins to be dispensed have been discharged to the coin output ports 15, 16, the coin boxes 17, 18 are drawn out from the housing 10 for completing the action of dispensing the coins.

The action of replenishing with the coins will be described.

For replenishing the machine, the coins to be re-deposited are input through the coin input port 12, which acts as a replenish inlet, into the input feeding portion 34. The coins are then fed one by one from the input feeding portion 34 by the same action as described previously and delivered by the delivering portion 81 to the corresponding projections 46 of the transporting belt 43 which runs through the receiving and transporting zone 39 of the coin passage 32.

The coins are pushed by the projections 46 of the transporting belt 43 and further transported from the receiving and transporting zone 39 to the identifying and transporting zone 40 of the coin passage 32 where their quality is examined by the identifying portion 58 at the identifying and transporting zone 40.

When the coins have been identified as normal coins by the identifying action of the identifying portion 58, they are transported from the identifying and transporting zone 40 to the sorting and transporting zone 41 where they are selectively picked up by the sorting portion 63 corresponding to the denomination-specific accommodating and ejecting portion 35 for the denominations to be re-supplied and stored in the denomination-specific accommodating and ejecting portion 35 depending on the denominations of the coins.

When the coins have been identified as abnormal coins by the identifying portion 58, e.g., the denomination type of coins has hardly been identified, and the action of repeating the identifying action has been preset, they are transported from the identifying and transporting zone 40 to the sorting and transporting zone 41 where they are selectively picked up by the sorting portion 63 corresponding to the input feeding portion 34 and returned to the input feeding portion 34. This allows the abnormal coins to be fed from the input feeding portion 34 to the coin passage 32 and examined once again by the identifying portion 58. The action of repeating the identifying action will hence minimize the number of the normal coins to be identified unfavorably as abnormal coins.

The abnormal coins will be removed when they only are present in the input feeding portion 34 and the coin passage 32 and the presence of a disqualified is detected more than a predetermined number of times by the identifying portion 58, or the action of repeating the identifying action has been not preset. More particularly, when the abnormal coins are to be handled by the teller at the right side, they are transported from the identifying and transporting zone 40 to the sorting and transporting zone 41, picked up by the sorting portion 63 disposed at the end of the downstream side and corresponding to the right coin output port 16, and discharged to the right coin output port 16. On the other hand, when the abnormal coins are to be handled by the teller at the left side, they are further transported from the sorting and transporting zone 41 to the dispensing and transporting zone 42, picked up by the sorting portion 71 corresponding to the left coin output port 15, and discharged to the left coin output port 15. The abnormal coins discharged to the two coin output ports 15, 16 are then recovered in the output boxes 17, 18 which are then withdrawn from the housing 10 for removal of the abnormal coins.

The action of recovering the coins will be described.

For recovering the coins, the coins to be recovered are fed one by one by denomination from the denomination-specific accommodating and ejecting portion 35 of interest. More specifically, the coins to be recovered are ejected one by one from the denomination-specific accommodating and ejecting portion 35 of interest by the same action as of the input feeding portion 34 described previously and delivered by the delivering portion 81 to the corresponding projections 46 of the transporting belt 43 which runs through the receiving and transporting zone 39 of the coin passage 32.

The coins to be recovered are pushed by the projections 46 of the transporting belt 43 and transported from the receiving and transporting zone 39 to the identifying and transporting zone 40 where their quality is examined by the identifying portion 58 at the identifying and transporting zone 40.

When the coins are identified as normal coins by the identifying action of the identifying portion 58, they are further transported from the identifying and transporting zone 40 to the sorting and transporting zone 41, picked up by the sorting portion 63 disposed at the end of the downstream side and corresponding to the right coin output port 16, discharged to the right coin output port 16, and recovered through the action of a diverting portion to a recovery cassette disposed in the lower end of the interior of the housing 10.

When the coins to be recovered have been identified as abnormal coins by the identifying portion 58, e.g., the denomination of coins has hardly been identified, and the action of repeating the identifying action has been preset, they are transported from the identifying and transporting zone 40 to the sorting and transporting zone 41 where they are selectively picked up by the sorting portion 63 corresponding to the denomination-specific accommodating and ejecting portion 35 of interest and returned to the denomination-specific accommodating and ejecting portion 35. This allows the abnormal coins to be fed from the denomination-specific accommodating and ejecting portion 35 of interest to the coin passage 32 and examined once again by the identifying portion 58. The action of repeating the identifying action will hence minimize the number of the normal coins to be identified unfavorably as abnormal coins.

The abnormal coins are discharged to the coin output ports 15, 16 for removal when they only are present in the denomination-specific accommodating and ejecting portion 35 and the coin passage 32 and their presence is detected more than a predetermined number of times, which has been preset, by the identifying portion 58 or the action of repeating the identifying action.

When the action of recovering the coins from all the denomination-specific accommodating and ejecting portions 35 of interest has been completed, the front door 21 of the housing 10 is opened up for drawing the recovery cassette out.

The action of inspecting the coins will be described.

The action of inspecting the coins is provided for precisely checking the stock of the coins in the denomination-specific accommodating and ejecting portions 35.

The coins to be inspected are ejected from the denomination-specific accommodating and ejecting portion 35 of interest by the same action as that of the input feeding portion 34 described previously and delivered by the delivering portion 81 to the corresponding projections 46 of the transporting belt 43 which runs through the receiving and transporting zone 39 of the coin passage 32. The coins are then pushed by the projections 46 of the transporting belt 43 and transported from the receiving and transporting zone 39 to the identifying and transporting zone 40 where their quality is examined by the identifying portion 58 at the identifying and transporting zone 40. The coins subjected to the identifying action are further transported from the identifying and transporting zone 40 to the sorting and transporting zone 41, picked up by the sorting portion 63 corresponding to the bulk escrow portion 36, and delivered to the bulk escrow portion 36 for temporal storage.

When the coins dispensed from the denomination-specific accommodating and ejecting portion 35 of interest have been subjected to the identifying action and fed into the bulk escrow portion 36, they are fed one by one from the bulk escrow portion 36 by the same action as that of the input feeding portion 34 described previously and delivered by the delivering portion 81 to the corresponding projections 46 of the transporting belt 43 which runs through the receiving and transporting zone 39 of the coin passage 32. The coins to be inspected are then pushed by the projections 46 of the transporting belt 43 and transported from the receiving and transporting zone 39 to the identifying and transporting zone 40 where their quality is examined by the identifying portion 58 at the identifying and transporting zone 40. The coins subjected to the identifying action are further transported from the identifying and transporting zone 40 to the sorting and transporting zone 41, picked up by the sorting portion 63 corresponding to the denomination-specific accommodating and ejecting portion 35 of interest, and returned back to the denomination-specific accommodating and ejecting portion 35 of interest.

This allows the coins to be passed two times through the identifying portion 58 and subjected two times to the identifying action through a single inspecting action, thus increasing the accuracy of the inspecting action. Since the coins are circulated through the denomination-specific accommodating and ejecting portion 35 of interest, the bulk escrow portion 36, and the coin passage 32, their transporting route for inspecting can be minimized.

This action of inspecting the coins is then repeated for the other denomination-specific accommodating and ejecting portions 35.

As described, the coin handling apparatus 11 conducts the actions of depositing, dispensing, replenishing, recovering, and inspecting the coins with the transporting belt 43 of an annular form running throughout the annular coin passage 32 for transporting the coins, whereby its transport mechanism including the depositing system and the dispensing system can be simplified in the arrangement and minimized in the overall dimensions as is constructed for common use.

While the coins are identified by the single identifying portion 58 disposed across the coin passage 32 during all the depositing, dispensing, replenishing, recovering, and inspecting actions, their identification is reliable particularly for the dispensing action and their accounting task can hence be improved in the accuracy.

Since the coins fed from the denomination-specific accommodating and ejecting portion 35 of interest are identified by the identifying portion 58, their examination at the outlet of the denomination-specific accommodating and ejecting portion 35 is not required thus allowing the denomination-specific accommodating and ejecting portions 35 to be common at the output side arrangement to each other. Also, the output side arrangement of the bulk escrow portion 36 can be designed equal to those of the denomination-specific accommodating and ejecting portions 35. Moreover, the sorting portions 63 can be identical in the arrangement, hence allowing the denomination-specific accommodating and ejecting portions 35 and the bulk escrow portion 36 to be located at desired positions.

Since the coins deposited and the coins to be dispensed are transported along the transporting direction of the annular transporting belt 43, their handling at different stations for the actions including the depositing action and the dispensing action can be carried out in one direction and their corresponding mechanisms and controls can be simplified.

Since the receiving and transporting zone 39 of the coin passage 32 where the coins to be dispensed are accepted is located different from the sorting and transporting zone 41 of the coin passage 32 where the coins deposited are sorted, the depositing action and the dispensing action can separately be carried out at consistency with the depositing system and the dispensing system provided in the common arrangement.

Since the input feeding portion 34, the denomination-specific accommodating and ejecting portions 35, and the bulk escrow portion 36 are located at the inner side of both the coin passage 32 and the transporting belt 43, their maintenance can easily be conducted without opening up the other mechanisms.

Since the input feeding portion 34, the denomination-specific accommodating and ejecting portions 35, the bulk escrow portion 36, and the identifying portion 58 are laid out in a row from the front side to the rear side and the bulk escrow portion 36 and the identifying portion 58 are located close to each other, the distance from the identifying station to the temporal storage station for transporting the deposited coins as well as the distance from the identifying station to the storage station for transporting the coins to be temporarily stored are can be shortened thus decreasing the overall handling time and minimizing the possibility of the coins jammed during the transporting action.

Since the input feeding portion 34, the denomination-specific accommodating and ejecting portions 35, and the bulk escrow portion 36 permit the coins to be accepted in a non-aligned state on the flat belts 78, the stock of the coins can be increased in the quantity. Also, during the delivering action, the coins in a non-aligned state can be aligned in a single row at a single layer on the flat belts 78 by a combination of the motion along the transporting direction of the flat belts 78 and the motion in a reverse direction of the reverse rollers 79 while the delivering portions 81 are operated to deliver the coins one by one to the corresponding projections 46 of the transporting belt 43.

Then, the movement of the coins fed from the input feeding portion 34 will be described. This movement is identical to the movement of the coins ejected from the denomination-specific accommodating and ejecting portions 35 and the bulk escrow portion 36 which are equal in the construction to the input feeding portion 34.

As shown in FIGS. 5 and 6, the height of the guide side surfaces 94 of the two guide portions 93 of the guide member 91 sandwiching the flat belt 78 is set lower than the inclined transporting surface 84 of the flat belt 78 and higher than the bottom surface of the flat belt 78. Accordingly, the coins can be shaken up on the inclined transporting surface 84 of the flat belt 78 as the coins at the downstream side along the transporting direction are pushed at angles against both the guide portions 93 by the coins at the upstream side along the transporting direction during the rotating motion of the flat belt 78.

Since the coins are shaken and advanced to the downstream side of the movement in the transporting direction on the inclined transporting surface 84 of the flat belt 78, their quantity to be stored can be increased. As no specific mechanism is needed for shaking the coins, the overall construction can be simplified.

Since the width of the flat belt 78 is set greater than the diameter of the coin and smaller than two times the diameter of the coin, the coins can be carried in a zigzag form on the inclined transporting surface 84 of the flat belt 78 thus allowing the coins at the downstream side of the movement in the transporting direction to be effectively pushed at angles against both the guide portions 93 by the coins at the upstream side of the movement in the transporting direction throughout the inclined transporting surface 84 of the flat belt 78 and increasing the effect of shaking the coins.

Figure 3:
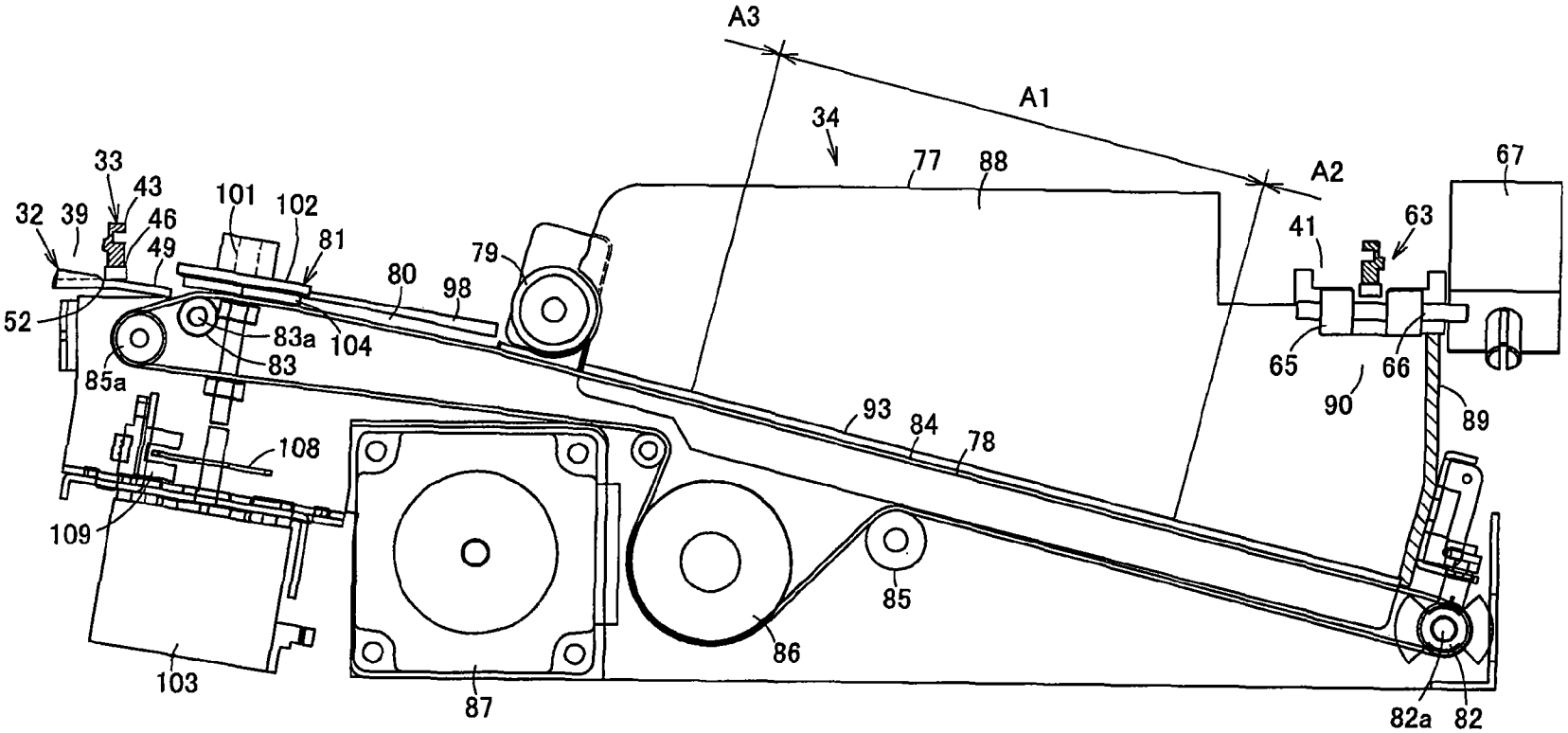
FIG. 3 is a cross sectional view of the coin handling apparatus.

As shown in FIG. 3, the height of the guide side edge 94 of the guide portion 93 is sized lower than the inclined transporting surface 84 at the upper side of the flat belt 78 and higher than the lower side of the flat belt 78 or falls within the thickness of the flat belt 78 throughout the area A1 of the flat belt 78 which extends substantially between the upstream side of the reverse roller 79 and the downstream side of the location just beneath the coin inlet 90 along the movement in the transporting direction. This ensures the ease of shaking the coins.

Meanwhile, throughout the area A2 which extends beneath the coin inlet 90 in the upstream side of the movement in the transporting direction, the height of the guide side edge 94 is sized higher than the inclined transporting surface 84 of the flat belt 78. This allows the coins to be contained on the inclined transporting surface 84 of the flat belt 78 between both the guide side edges 94 of the guide portions 93, hence ensuring the efficiency of delivering the coins towards the downstream side of the movement in the transporting direction. Similarly, throughout the area A3 where the reverse roller 79 is located in the downstream side of the movement in the transporting direction, the height of the guide side edge 94 is sized higher than the inclined transporting surface 84 of the flat belt 78. This allows the coins to be contained on the inclined transporting surface 84 of the flat belt 78 between both the guide side edges 94 of the guide portions 93, hence permitting the coins to be securely carried in a single row at a single layer.

Also as shown in FIG. 3, the flat belt 78 in the input feeding portion 34 is arranged with its inclined transporting surface 84 extending at an angle upwardly from the upstream side of the movement in the transporting direction to the downstream side of the movement in the transporting direction while the coin passage 32 is arranged with its inclined passage surface 49 extending at the same angle as of the inclined transporting surface 84 of the flat belt 78. This allows the coins from the inclined transporting surface 84 of the flat belt 78 to be directly accepted and transported by the inclined passage surface 49 in their inclined state. Accordingly, as its flat belt needs not to have such a bent as in the conventional art at the intermediate location for making the downstream side of the transporting movement horizontal, the input feeding portion 34 can be simplified in the construction, thus preventing the coins from being jammed during the transporting movement as resulting from the shape of the bent.

Since the flat belt 78 includes no bent at the intermediate location, its downstream side of the transporting movement is elevated higher than that with the bent. Accordingly, the coin passage 32 remains higher and its location for receiving the coins from the input feeding portion 32 is elevated by a moderate margin which thus contributes to the increase of the number of the coins to be saved in the input feeding portion 34.

Since the coins transported on the inclined passage surface 49 along the coin passage 32 are shifted from their inclined position to their horizontal position by the action of the shifting passage surface 53 and further transported on the horizontal passage surface 54, they can certainly be subjected along the horizontal passage surface 54 to the identifying action in the identifying and transporting zone 40 and the sorting action in the sorting and transporting zone 41 of the coin passage 32.

Since the grooved clearance 52 is provided in the inclined passage surface 49 of the coin passage 32 for spacing from the projection 46 of the transporting belt 43, the collision between the projection 46 and the inclined passage surface 49 can be avoided thus allowing the coins to be transported one by one at consistency as pushed by their respective projections 46.

The movement of the coins delivered from the delivering portion 81 will be described referring to FIGS. 7 and 8. FIG. 7 illustrates the action of ejecting the large-diameter coins and FIG. 8 illustrates the action of ejecting the small-diameter coins. While the action of the delivering portion 81 with the guide lever 122 at the coin output end 80*a* is shown in the denomination-specific accommodating and ejecting portion 35 and the bulk escrow portion 36 respectively, it is equal to that in the input feeding portion 34.

As shown in FIGS. 7(*a*) and 8(*a*), with the cam 102 located at the start position in the delivering portion 81, the coin moves into one of the recessed portions 105 while being carried directly along the guide member 97 at one side by the flat belt 78 and stops upon coming into direct contact with the stopper portion 107 of the projected portion 104.

As shown in FIGS. 7(*b*) and 8(*b*), the succeeding coin following the coin interrupted by the cam 102 then strikes the coin interrupted by the cam 102 and stops its movement.

As shown in FIGS. 7(*c*) and 8(*c*), when the sensor 110 detects the coin interrupted by the cam 102, the cam 102 is turned in the transporting direction at the timing for delivering the coin to the corresponding projection 46 of the transporting belt 43 in response to the location of the projections 46.

As shown in FIGS. 7(*d*), 7(*e*), 7(*f*), and FIGS. 8(*d*), 8(*e*), 8(*f*), when the cam 102 is turned, the projected portion 104 at the other side moves in between the preceding coin and the succeeding coin while pressing the preceding coin with its pushing portion 106 towards the coin passage 32 thus to interrupt the movement of the succeeding coin with the stopper portion 107 at the outer side thereof.

As shown in FIGS. 7(*g*) and 8(*g*), the coin to be delivered is pushed forward by the pushing portion 106 of the projected portion 104 at the other side to the location in the coin passage 32 where it is accepted by the projection 46 of the transporting belt 43.

As shown in FIGS. 7(*h*) and 8(*h*), the coin pushed into the coin passage 32 is then held and transported by the projection 46 of the transporting belt 43. The cam 102 then turns 180 degrees and stops at its start position. As the succeeding coin moves into the recessed portion 105 at the other side and its presence is detected by the sensor 110, the cam 102 is turned in the transporting direction at a pre-determined timing for delivering the succeeding coin to the corresponding projection 46 of the transporting belt 43 in response to the location of the projections 46.

As described, the cam 102 when having pushed and delivered the preceding coin with its pushing portion 106 to the corresponding projection 46 of the transporting belt 43 holds the succeeding coin with its stopper portion 107 before the next delivering motion, whereby the coins can certainly be delivered one by one to the corresponding projections 46 of the transporting belt 43.

Alternatively, the coin passage 32 may be arranged of an annular shape by joining the trailing end of the dispensing and transporting zone 42 to the leading end of the receiving and transporting zone 39 of the coin passage 32.

The transporting body is not limited to the transporting belt 43 but may be implemented by, for example, wires or chains. In the latter case, the rotating member is not limited to the roller but may be a sprocket.

The number of the denomination-specific accommodating and ejecting portions 35 is not limited to six.

The denominations of coins to be stored in the denomination-specific accommodating and ejecting portions 35 may arbitrarily be determined. For example, the denomination of coins not to be used for the dispensing action and the denomination of coins to be accommodated at full stock may be stored in a combination.

The functional units joined with the transporting unit 33 may be selected from a denomination-specific escrow portion for temporarily storing the coins of one denomination, a bulk accommodating and dispensing portion for storing and dispensing the coins in bulk, a reject box for storing rejected coins, a recovery cassette for storing the coins recovered, a replenish cassette for storing the coins to be replenished, and so on.

INDUSTRIAL APPLICABILITY

The present invention is applicable to a coin depositing and dispensing apparatus for depositing and dispensing money in coins or a money handling apparatus which is a combination of a coin depositing and dispensing machine for depositing and dispensing coins and a bank note depositing and dispensing machine for depositing and dispensing bank notes.

The invention claimed is:

1. A coin depositing and dispensing machine, comprising:

an annular coin passage;

a transporting unit including a single annular transporting body and a supporting body for supporting the transporting body rotatably in a circular direction, the transporting body transporting deposited coins and dispensed coins which are received in the annular coin passage; and an accommodating and ejecting portion which is located at the inner side of the annular coin passage for accepting and storing the coins from the annular coin passage in the accommodating and electing portion, the accommodating and ejecting portion also ejecting the stored coins from the accommodating and ejecting portion to the annular coin passage, such that the annular coin passage receives the stored coins.

2. A coin depositing and dispensing machine according to claim 1, wherein the transporting unit drives the transporting body to travel only in one direction for transporting the deposited coins and the dispensed coins.

3. A coin depositing and dispensing machine according to claim 1, wherein the transporting unit has a deposited-coin sorting and transporting zone for sorting the deposited coins, and a dispensed-coin receiving and transporting zone for receiving the dispensing coins, both of which are located in different regions in the transporting unit.

4. A coin depositing and dispensing machine according to claim 1, wherein the transporting body has a plurality of projections provided thereon for pushing and transporting the coins respectively.

5. A coin depositing and dispensing machine according to claim 1, wherein the transporting unit is connected with a coin input port for receiving the deposited coins, a coin output port for discharging the dispensing coins, an identifying portion for identifying the coins, an escrow portion for temporarily storing the coins.

6. A coin depositing and dispensing machine according to claim 1, wherein the coin passage includes a coin input port for receiving the deposited coins, an input feeding portion for feeding the deposited coins one by one, a coin output port for discharging the coins to be dispensed, an identifying portion for identifying the coins, a denomination-specific escrow portion for temporarily storing the coins for each denomination, a bulk escrow portion for temporarily storing the coins in bulk, a denomination-specific accommodating and ejecting portion as the accommodating and ejecting portion for accommodating coins in the accommodating and ejecting portion for each denomination as well as for ejecting the stored coins therefrom, a bulk accommodating and dispensing portion for temporarily accommodating the coins in bulk and dispensing the stored coins, a reject box for accommodating rejected coins, a recovery cassette for accommodating recovered coins, a replenish cassette for accommodating replenished coins, and a diverting gate for diverting the coins from the transporting unit.

7. A coin depositing and dispensing machine according to claim 5, wherein the coins input into the coin input port in a non-aligned state are fed one by one to the transporting unit, transported one by one by the transporting unit, and temporarily stored in the escrow portion when the coins have been identified as normal coins by the identifying portion.

8. A coin depositing and dispensing machine according to claim 5, wherein the coins accepted in non-aligned state by the accommodating and ejecting portion are fed one by one to the transporting unit, transported one by one by the transporting unit, and dispensed to the coin output port.

9. A coin depositing and dispensing machine according to claim 5, wherein the coins accepted in a non-aligned state by the accommodating and ejecting portion are fed one by one to the transporting unit, transported one by one by the transporting unit, and dispensed to the coin output port when the coins have been identified as normal coins by the identifying portion.

10. A coin depositing and dispensing machine according to claim 6, wherein the input feeding portion, the bulk escrow portion, and the denomination-specific accommodating and ejecting portion are at least provided and all located at the inner side of the transporting unit in an annular form.

11. A coin depositing and dispensing machine according to claim 6, wherein the input feeding portion, the coin output port, the identifying portion, the bulk escrow portion, and the denomination-specific accommodating and ejecting portion are at least provided, the input feeding portion and the coin output port being located at the front side of the machine while the input feeding portion, the denomination-specific accommodating and ejecting portion, the bulk escrow portion, and the identifying portion are located in a succession from the front side to the rear side.

12. A coin depositing and dispensing machine according to claim 11, wherein the coins fed from the input feeding portion, the denomination-specific accommodating and ejecting portion, and the bulk escrow portion are transported in one direction along a transporting passage of the transporting unit and subjected to the identifying action of the identifying portion.

13. A coin depositing and dispensing machine according to claim 6, wherein each of the denomination-specific escrow portion, the bulk escrow portion, the denomination-specific accommodating and ejecting portion, and the bulk accommodating and dispensing portion is arranged for receiving the coins in a non-aligned state and includes a belt mounted between rollers supported pivotably by horizontally extending axes for traveling at an angle upwardly from the upstream side to the downstream side of the movement in the transporting direction, a reverse roller disposed above the downstream side of the movement in the transporting direction for rotating in a reverse direction of the movement of the belt thus to eject the coins, which have been in the non-aligned state, in a single row at a single layer on the belt, and a delivering portion for delivering the coins one by one to the transporting body of the transporting unit.

14. A coin depositing and dispensing machine according to claim 6, wherein the input feeding portion is arranged for receiving the coins in a non-aligned state and includes a belt mounted between rollers supported pivotably by horizontally extending axes for traveling at an angle upwardly from the upstream side to the downstream side of the movement in the transporting direction, a reverse roller disposed above the downstream side of the movement in the transporting direction for rotating in a reverse direction of the movement of the belt thus to feed the coins, which have been in the non-aligned state, in a single row at a single layer on the belt, a delivering portion for delivering the coins one by one to the transporting body of the transporting unit, and an input port for receiving the coins one by one transported by the transporting unit.

15. A coin depositing and dispensing machine according to claim 6, wherein a coin input port and the input feeding portion are provided, the coin input port being located at the upper side of the input feeding portion and arranged to serve as a replenish input port for replenishing the machine with the coins.

16. A coin depositing and dispensing machine according to claim 5, wherein the coins identified as abnormal coins by the identifying portion are circulated by the transporting unit and subjected again to the identifying action of the identifying portion.

17. A coin depositing and dispensing machine according to claim 6, wherein the input feeding portion, the identifying portion, the bulk escrow portion, and the diverting gates are at least provided so that the coins fed from the input feeding portion are transported by the transporting unit at the time of counting the coins before the approval of the deposited coins and subjected to the identifying action of the identifying portion, and then the coins identified as normal coins are diverted in the bulk escrow portion by the diverting gate corresponding to the coin input of the bulk escrow portion while the coins identified as abnormal coins are diverted and returned by the diverting gate corresponding to the returning of the coins.

18. A coin depositing and dispensing machine according to claim 6, wherein the input feeding portion, the identifying portion, the bulk escrow portion, and the diverting gates are at least provided so that the coins fed from the input feeding portion are transported by the transporting unit at the time of counting the coins before the approval of the deposited coins and subjected to the identifying action of the identifying portion, and then the coins identified as normal coins are diverted in the bulk escrow portion by the diverting gate corresponding to the coin input of the bulk escrow portion while the coins identified as abnormal coins are diverted and sent back to the input feeding portion by the diverting gate corresponding to the coin input of the input feeding portion from which the abnormal coins are fed to the transporting unit and subjected once again to the identifying action of the identifying portion.

19. A coin depositing and dispensing machine according to claim 17, wherein the denomination-specific accommodating and ejecting portion is provided so that the coins fed from the bulk escrow portion are transported by the transporting unit at the time of counting the coins before the approval of the deposited coins and subjected to the identifying action of the identifying portion and then the coins identified as normal coins are diverted in the denomination-specific accommodating and ejecting portion by the diverting gate corresponding to the coin input of the denomination-specific accommodating and ejecting portion while the coins identified as abnormal coins are diverted and returned by the diverting gate corresponding to the returning of the coins.

20. A coin depositing and dispensing machine according to claim 17, wherein the denomination-specific accommodating and ejecting portion is provided so that the coins fed from the bulk escrow portion are transported by the transporting unit at the time of counting the coins before the approval of the deposited coins and subjected to the identifying action of the identifying portion, and then the coins identified as normal coins are diverted in the denomination-specific accommodating and ejecting portion by the diverting gate corresponding to the coin input of the denomination-specific accommodating and ejecting portion while the coins identified as abnormal coins are diverted and sent back to the input feeding portion by the diverting gate corresponding to the coin input of the input feeding portion from which the coins are fed to the transporting unit and subjected once again to the identifying action of the identifying portion.

21. A coin depositing and dispensing machine according to claim 6, wherein the coin output port, the identifying portion, the denomination-specific accommodating and ejecting portion, and the diverting gate are at least provided and, in addition, a controller is provided for directing the coins of a denomination, demanded from the outside, to be ejected from the denomination-specific accommodating and ejecting portion to the transporting unit and subjected to the identifying action of the identifying portion, and then the coins identified as normal coins are diverted and fed by one of the two diverting gates which are located corresponding to the above respective coin output ports disposed at both, left and right, ends of the front side of the machine while the coins identified as abnormal coins are diverted and returned back to the denomination-specific accommodating and ejecting portion by the diverting gate corresponding to the coin input of the denomination-specific accommodating and ejecting portion and simultaneously directing a number of the coins equal to the number of the abnormal coins to be ejected once again from the denomination-specific accommodating and ejecting portion to the transporting unit.

* * * * *